US008776611B2

(12) United States Patent
Sangel et al.

(10) Patent No.: US 8,776,611 B2
(45) Date of Patent: Jul. 15, 2014

(54) REMOTELY ACCESSIBLE SUBSEA STRAIN SENSOR ASSEMBLIES AND METHODS

(75) Inventors: Jonathan Sangel, Vista, CA (US); Andrew Mail, San Marcos, CA (US); Brian Gallagher, San Diego, CA (US); John Engel, Port Townsend, WA (US)

(73) Assignee: BMT Scientific Marine Services, Inc., Houston, TX (US)

( * ) Notice: Subject to any disclaimer, the term of this patent is extended or adjusted under 35 U.S.C. 154(b) by 134 days.

(21) Appl. No.: 13/303,031

(22) Filed: Nov. 22, 2011

(65) Prior Publication Data

US 2012/0151743 A1 Jun. 21, 2012

Related U.S. Application Data

(60) Provisional application No. 61/416,711, filed on Nov. 23, 2010.

(51) Int. Cl.
*G01N 3/00* (2006.01)

(52) U.S. Cl.
USPC ..... 73/816; 73/818; 405/188

(58) Field of Classification Search
USPC ..... 73/760, 784, 816, 818; 405/188
See application file for complete search history.

(56) References Cited

U.S. PATENT DOCUMENTS

| | | | | |
|---|---|---|---|---|
| 3,800,869 | A * | 4/1974 | Herd et al. | 166/337 |
| 3,857,452 | A | 12/1974 | Hartman | |
| 4,487,078 | A | 12/1984 | Schmitz et al. | |
| 4,735,238 | A * | 4/1988 | Reeves, Jr. | 141/1 |
| 4,932,253 | A | 6/1990 | McCoy | |
| 5,046,895 | A | 9/1991 | Baugh | |
| 5,437,517 | A * | 8/1995 | Carrioli et al. | 405/169 |
| 5,814,181 | A | 9/1998 | Richter et al. | |
| 6,059,264 | A | 5/2000 | Kaminski et al. | |
| 6,292,436 | B1 | 9/2001 | Rau et al. | |
| 6,315,497 | B1 | 11/2001 | Wittman et al. | |
| 6,374,893 | B1 | 4/2002 | Behl | |
| 6,698,014 | B1 | 2/2004 | Rechter | |
| 6,705,401 | B2 * | 3/2004 | Buckle et al. | 166/337 |

(Continued)

FOREIGN PATENT DOCUMENTS

| | | | |
|---|---|---|---|
| GB | 2431974 | A | 5/2007 |
| WO | WO 2006/050488 | A1 | 5/2006 |
| WO | WO 2008/154604 | A1 | 12/2008 |

OTHER PUBLICATIONS

International Preliminary Report on Patentability from International Application No. PCT/US2011/061966, mailed Jun. 6, 2013, in 9 pages.

(Continued)

*Primary Examiner* — Max Noori
(74) *Attorney, Agent, or Firm* — Knobbe, Martens, Olson & Bear, LLP

(57) ABSTRACT

A system and method for the installation and removal of monitoring equipment is disclosed. In some embodiments, the monitoring equipment may be installed or removed using a remotely operated vehicle. In certain implementations, the monitoring system includes a sensor assembly connectable to a tubular member, an alignment tool for installing or removing the sensor assembly to and from the tubular member, and an alignment cage for facilitating access of the alignment tool to the sensor assembly. In some embodiments, the alignment tool may be aligned with the sensor assembly for installation or removal as a result of the alignment tool being inserted through the alignment cage.

20 Claims, 16 Drawing Sheets

(56) References Cited

U.S. PATENT DOCUMENTS

| | | | | |
|---|---|---|---|---|
| 6,959,604 | B2 | 11/2005 | Bryant et al. | |
| 6,993,568 | B1 | 1/2006 | Hauduc et al. | |
| 7,171,315 | B2 | 1/2007 | Loose | |
| 7,194,913 | B2 | 3/2007 | Morrison et al. | |
| 7,272,821 | B2 | 9/2007 | Chittar et al. | |
| 7,343,818 | B2 | 3/2008 | Gysling et al. | |
| 7,536,537 | B2 | 5/2009 | Linn | |
| 7,891,254 | B2 | 2/2011 | Edwards, Jr. et al. | |
| 8,056,634 | B2 * | 11/2011 | Spencer | 166/341 |
| 2005/0100414 | A1 | 5/2005 | Salama | |
| 2006/0115335 | A1 | 6/2006 | Allen et al. | |
| 2007/0005342 | A1 | 1/2007 | Ortscheid | |
| 2007/0256062 | A1 | 11/2007 | Madden | |
| 2008/0303382 | A1 | 12/2008 | Edwards, Jr. et al. | |
| 2010/0065326 | A1 | 3/2010 | Ko | |

OTHER PUBLICATIONS

Communication Pursuant to Rules 161(1) and 162 EPC from European Application No. 11801898.5, dated Aug. 14, 2013, 2 pages.

Edwards, Roderick Y., Jr., et al, "Load Monitoring at the Touchdown Point of the First Steel Catenary Riser Installed in a Deepwater Moored Semisubmersible Platform", Offshore Technology Conference, OTC 10975, May 1999, in 9 pages.

G. Thivend, "Subsea Sensors for Non-Intrusive Monitoring of Temperature, Pressure and Asset Integrity", Offshore Technology Conference, vol. OTC 20980, May 6, 2010, XP055048297, 9 pages.

Pictures of a display publicly exhibited at the Offshore Technology Conference in Houston, Texas, May 2009, and the Deep Offshore Technology Conference in Houston, Texas, Feb. 2010, 8 pages.

International Search Report and Written Opinion from International Application No. PCT/US2011/061966, mailed Jan. 7, 2013, 16 pages.

International Preliminary Report on Patentability from International Application No. PCT/US2008/066606, Dec. 30, 2009, 7 pages.

International Search Report and Written Opinion from International Application No. PCT/US2008/066606, Sep. 11, 2008, 10 pages.

"The Marine Analyst", Jan. 1, 2009, Issue 1, retrieved from the internet: URL: http://media.bmt.org/bmt_media/resources/35/2009Issue1_OTC_fore-mail.pdf, XP055048234, retrieved on Dec. 18, 2012, 8 pages.

"The Marine Analyst", Nov. 30, 2010, Issue 2, retrieved from the Internet: URL: http://media.bmt.org/bmt_media/resources/35/2010Issue2_Fall_email.pdf, XP055048375, retrieved on Dec. 19, 2012, 8 pages.

* cited by examiner

REMOTELY ACCESSIBLE SUBSEA STRAIN SENSOR ASSEMBLIES AND METHODS

CROSS-REFERENCE TO RELATED APPLICATIONS

This application claims the priority benefit under 35 U.S.C. §119(e) of U.S. Provisional Patent Application No. 61/416,711, filed Nov. 23, 2010, titled "REMOTELY ACCESSIBLE SUBSEA STRAIN SENSOR ASSEMBLY," the entirety of which is incorporated herein by reference.

BACKGROUND

1. Field

The present developments relate to the repair and/or replacement of monitoring equipment, for example, equipment for monitoring the strain on a section of underwater pipe.

2. Description of the Related Art

Gas and oil drilling is performed in many different ways, on land and at sea. In marine drilling operations, large sections of steel pipe (which are typically referred to as "risers" or "flowlines") are connected to stretch deep into the ocean and along the seabed. The length of this piping required to reach the sea floor, motion of the platform, station, rig, or vessel the piping stretches from, ocean currents, self-weight of the piping, buoyancy, the pressure extremes, and the temperature extremes to which such piping is subjected to often result in undesirable strain, tension, and/or bending in the pipe.

The resulting bending and tension induce strains in the pipe. Unanticipated failure of such pipes can result in severe pollution and heavy economic loss. Thus, in some cases, sensors, sensor assemblies, or systems for monitoring strain in submerged pipes are coupled to the pipe in order to enable a continuous assessment of the integrity of the pipe. When a sensor needs repair or replacement, it is often desirable to remove or replace the sensor in place at or near the seabed. However, in some cases due to the extreme pressures and prohibitive costs, sending human divers to conduct the repair or replacement is not efficient or even possible. In such cases, a submarine robot, such as a remotely operated vehicle (ROV), may be required to reach the sensor assembly. However, heretofore due to, e.g., complexity in the mounting system of the sensor assembly and/or difficulty in maintaining the position of the ROV relative to the sensor, such removal, replacement, and/or repair has had little success. Accordingly, previous sensor systems have largely been non-serviceable and have relied on redundant sensors to increase the chance of continued operation in the event of a sensor failure. Such redundant sensor systems, however, can be larger in size, require additional time to install and test, and be more costly. Further, such systems yet may not provide continued operation in the event of multiple sensor failures.

SUMMARY

An aspect of at least one of the embodiments disclosed herein is the realization that a monitoring system for a tubular member can be configured to have a first mounting point and a second mounting point disposed at fixed locations on the tubular member. The monitoring system can further include a sensor assembly having a first end configured to couple and decouple to the first mounting point and a second end configured to couple and decouple to the second mounting point. Some embodiments provide an alignment tool that is connectable to the sensor assembly and configured to mate with the first and second ends of the sensor assembly to facilitate the coupling and decoupling of the first end with the first mounting point and the second end with the second mounting point. The monitoring system can further include an alignment cage configured to guide the alignment tool into a mating configuration with the first and second ends of the sensor assembly.

In some embodiments, a monitoring system for an underwater tubular member includes a sensor assembly that is configured to measure strain on the tubular member. The sensor assembly can include a first end configured to couple and decouple with a first mounting point of the tubular member and a second end configured to couple and decouple with a second mounting point of the tubular member. The system can also include an alignment cage coupled with the tubular member. Further, some implementations of the system include an alignment tool. Some embodiments of the alignment tool are configured to be manipulated by a remotely operated vehicle. Some implementations of the alignment tool are configured to be received in the alignment cage. Some embodiments of the alignment tool are configured to couple with the sensor assembly. In certain implementations, the alignment tool has a first opening and a second opening. The first opening can be configured to receive the first end of the sensor assembly and the second opening can be configured to receive the second end of the sensor assembly.

In certain embodiments, when the alignment tool is received in the alignment cage, the first opening of the alignment tool, the first end of the sensor assembly, and the first mounting point of the tubular member are substantially aligned and the second opening of the alignment tool, the second end of the sensor assembly, and the second mounting point of the tubular member are substantially aligned. Such a configuration can, for example, facilitate coupling and decoupling of the first end of the sensor assembly with the first mounting point of the tubular member and coupling and decoupling of the second end of the sensor assembly with the second mounting point of the tubular member.

In some embodiments, the alignment tool includes a channel and the alignment cage includes a rib. The channel can be configured to receive the rib, thereby guiding the alignment tool into the alignment cage. In certain implementations, the channel further includes a first positioning feature and the rib further includes a second positioning feature. The first positioning feature and the second positioning feature can be configured to inhibit removal of the alignment tool from the alignment cage.

In certain implementations, the sensor assembly further includes a notch. In some such variants, at least the first opening of the alignment tool includes a latch element. The latch element can be movable between an extended position and a retracted position. In certain arrangements, the latch can be moved from the retracted position to the extended position, and be received in the notch, when the alignment cage is received in the alignment tool. In certain instances, the alignment tool further includes a lever configured to move the latch element between the extended and retracted positions.

In some embodiments, the first mounting point also includes an alignment post mounted to the tubular member. Further, the first end of the sensor assembly can include a mounting block configured to engage the alignment post. In some implementations, the alignment post also has a base, conduit, and spool. The spool can be configured to receive the conduit. The mounting block can be configured to receive the spool.

In certain embodiments, the first and second ends of the sensor assembly and the first and second mounting points include corresponding positioning features configured to facilitate alignment of the sensor assembly and the first and second mounting points. In certain implementations, at least the first end of the sensor assembly further has a fastener. The fastener can be configured to couple the first end with first mounting point. In some embodiments, the alignment tool includes an upper section and a lower section with a middle section therebetween. In some configurations, the middle section is narrower than the upper and lower sections. In certain implementations, the alignment tool further comprises a handle for positioning the alignment tool. In some variants, monitoring system also includes the remotely operated vehicle.

In some embodiments, a method of remotely removing a monitoring system from a tubular member includes engaging an alignment tool and an alignment cage with a remotely operated vehicle. The method can also include inserting a portion of the sensor assembly in an opening of the alignment tool. The sensor assembly can have a fastener that secures the sensor assembly with an alignment post of the tubular member. The method can further include coupling the alignment tool and the sensor assembly. Additionally, the method can include loosening the fastener. Also, the method can include removing the alignment tool and the sensor assembly as a unit (e.g., a single assembly) from the alignment cage and the alignment post with the remotely operated vehicle. For example, in certain embodiments, the ROV moves the alignment tool and the sensor assembly radially (in relation to the tubular member), thereby moving the alignment tool and the sensor assembly out of and away from the alignment cage and the alignment post.

In certain implementations, the method removing a monitoring system from a tubular member also includes holding the alignment tool in the alignment cage with a first positioning feature on the alignment tool and a second positioning feature on the alignment cage. The first positioning feature and the second positioning feature can be configured to releasably mate. In some embodiments, the method further includes turning a lever. The lever can be coupled with a latch element on the alignment tool. In some embodiments, the method further includes moving the latch element from a retracted position to an extended position. Moreover, the method can include receiving the latch element in a slot in the sensor assembly. In certain variants, the method also includes inserting a wrench into a head portion of the fastener and turning the wrench.

In some embodiments, a method of remotely installing a monitoring system with a tubular member includes engaging an alignment tool and an alignment cage with a remotely operated vehicle. The alignment tool can be coupled with a sensor assembly. In some implementations, the method also includes mating a portion of the sensor assembly with an alignment post coupled with the tubular member. The method can also include securing the sensor assembly with the alignment post. Further, the method can include decoupling the alignment tool and the sensor assembly. Some variants of the method also include disengaging the alignment tool from the alignment cage. Moreover, the method can include separating the alignment tool from the alignment cage and the sensor assembly. In certain such instances, the sensor assembly remains connected with the alignment post.

In some embodiments, the method also includes holding the alignment tool in the alignment cage with a first positioning feature on the alignment tool and a second positioning feature on the alignment cage. The first positioning feature and the second positioning feature can be configured to releasably mate. In certain implementations, the method further includes inserting a wrench into a head portion of a fastener of the sensor assembly and turning the wrench. The method can additionally include turning a lever. The lever can be coupled, for example, with a latch element on the alignment tool. Some embodiments of the method include moving the latch element from an extended position to a retracted position. Moreover, some implementations of the method include removing the latch element from a slot in the sensor assembly.

In accordance with certain implementations, a system for mounting a sensor on an underwater tubular member having at least one sensor mounting location thereon includes an alignment cage having a guide section. The alignment cage can be configured to couple with the tubular member. The system can further include an alignment tool, which can be configured to be manipulated by a remotely operated vehicle. Certain embodiments of the alignment tool have at least one opening and a guide channel. In some implementations, the alignment tool is configured to be received in the alignment cage such that the guide channel of the alignment tool and the guide section of the alignment cage slidably engage. In certain such arrangements, the alignment tool is thereby substantially aligned along a longitudinal axis of the tubular member. In some embodiments, when the alignment tool is received in the alignment cage, the at least one opening in the alignment tool is substantially coaxial with the at least one sensor mounting location of the tubular member. For example, a fastener passed through the at least one opening can be received in an aperture in the at least one sensor mounting location.

In certain implementations, the system further includes a sensor assembly. The sensor assembly can be configured to couple with the at least one mounting location of the tubular member. In some embodiments, the alignment tool is configured to releasably connect with a sensor assembly. In certain embodiments, the guide section also has a rib and the guide channel is configured to receive the rib. In some instances, the alignment tool has a figure-eight shape (e.g., a wider upper and lower section and a narrower middle section). In certain embodiments, the guide section and the guide channel are configured to be releasably connected with a detent (e.g., a spring detent). In some such cases, the detent is configured to inhibit or prevent the alignment tool from separating from the alignment cage. For example, the detent can be configured to retain the alignment tool in the alignment cage until the alignment tool is pulled from the alignment cage by the remotely operated vehicle. In some cases, the detent includes a spring-loaded projection on the alignment tool and a corresponding recess in the alignment cage (e.g., in the guide section).

DETAILED DESCRIPTION

Figure 1A:
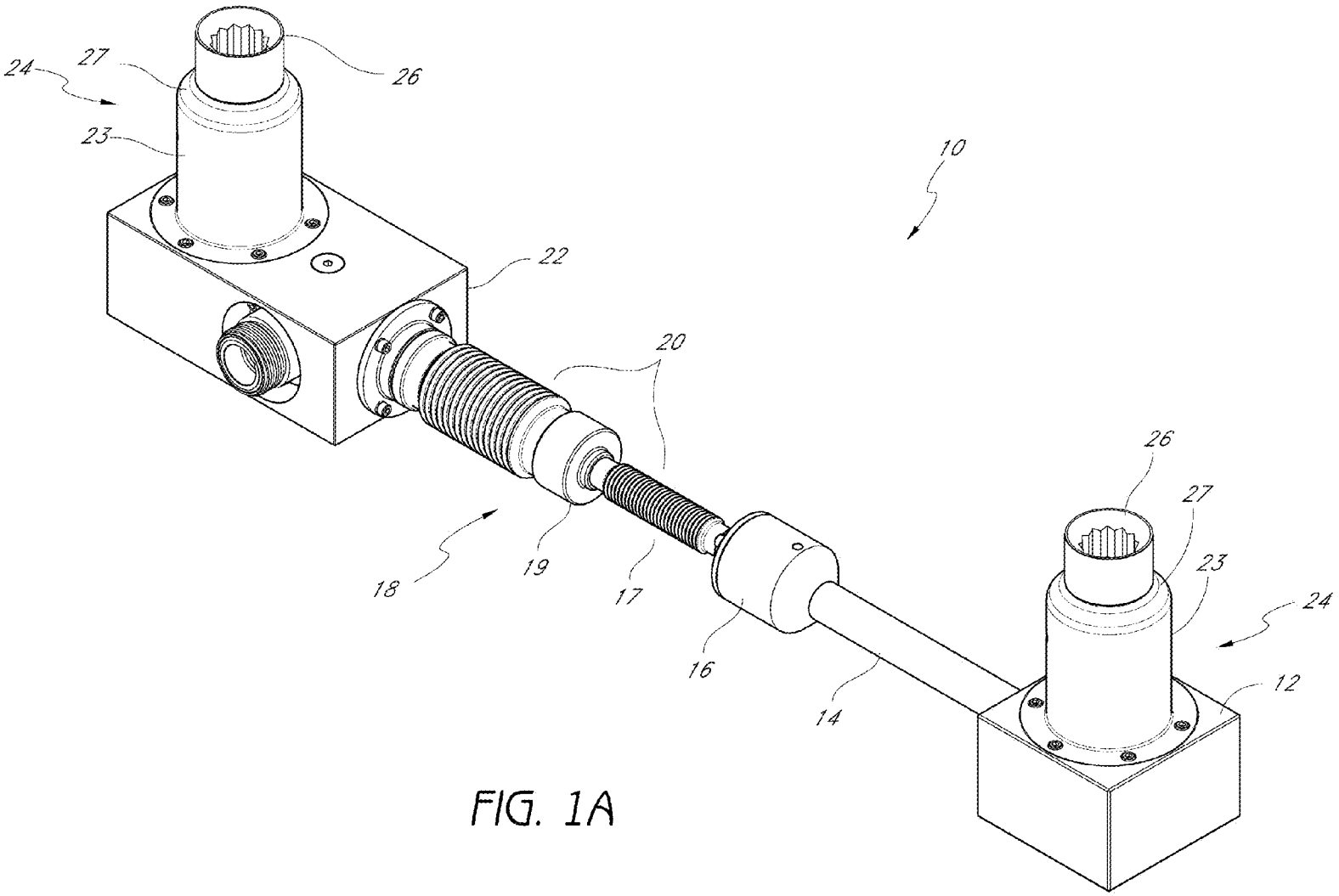
FIGS. 1A-1D illustrate isometric, top, front, and bottom views, respectively, of an embodiment of a sensor assembly.
Figure 1B:
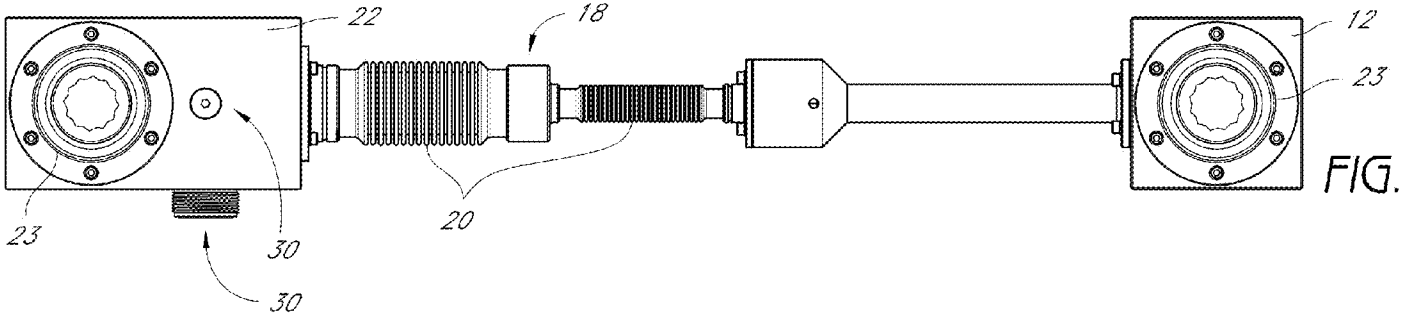
Figure 1C:
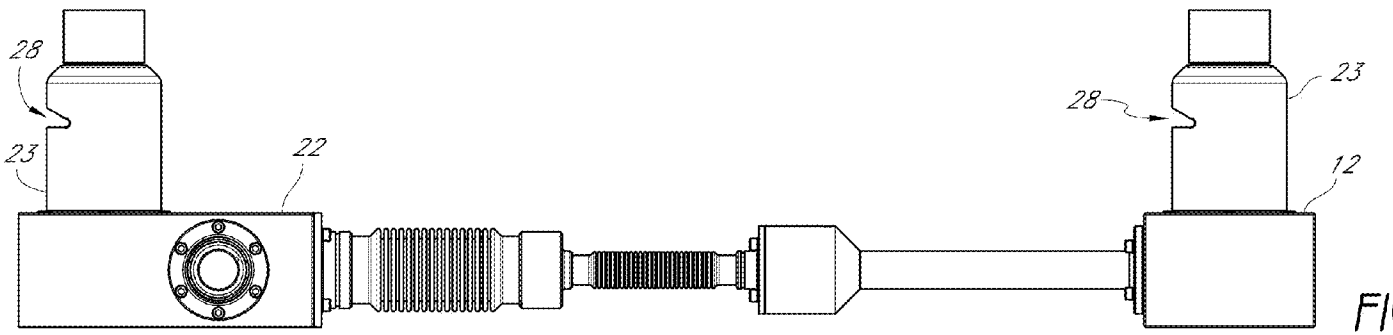
Figure 1D:
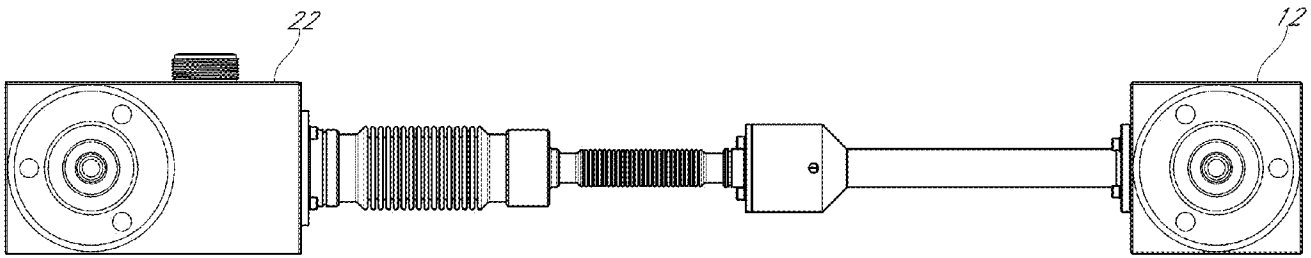

A variety of examples of subsea strain sensor assemblies, protection, fastening, and alignment devices, as well as systems and methods thereof, are described below to illustrate various examples that may be employed to achieve the desired improvements, such as but not limited to improvements in the remote positioning of subsea sensors with a high degree of precision and accuracy. These examples are only illustrative and not intended in any way to restrict the inventions presented and the various aspects and features of these inventions. For example, although embodiments and examples are provided herein in the marine field, the inventions are not confined exclusively to the marine field and can be used in other fields. Furthermore, the phraseology and terminology used herein is for the purpose of description and should not be regarded as limiting. No feature, structure, or step disclosed herein is essential or indispensible.

As will be discussed in further detail below, in some embodiments, a subsea strain sensor assembly 5 includes a sensor assembly 10, an alignment tool 110, and an alignment cage 210. In some embodiments, the sensor assembly 10 can be coupled with a tubular member 202 (e.g., a portion of an undersea pipeline) either directly or indirectly. In certain implementations, the alignment cage 210 couples with the tubular member 202. For example, the alignment cage 210 can partially surround and/or protect the sensor assembly 10. In some embodiments, the alignment cage 210 is configured to receive and/or couple with the alignment tool 110. In certain such instances, the alignment tool 110 is configured to the receive sensor assembly 10. In some arrangements, some or all of the sensor assembly 10 can be decoupled from the tubular member 202, thereby allowing the sensor assembly 10 to be removed from the tubular member 202.

With regard to FIGS. 1A-1D, an embodiment of the sensor assembly 10 is illustrated. The illustrated embodiment includes a first mount block 12 coupled to an elongate spacer bar 14. In some arrangements, the spacer bar 14 includes a radially expanded section 16. The spacer bar 14 can be connected to an armature 17, which in turn can be interfaced with a sensor body 18 having a sensor 19, such as a displacement sensor, configured to measure displacement of the armature 17 relative to the sensor body 18. In some embodiments, the armature 17, sensor body 18, and sensor 19 are configured to form a linear variable differential transformer (LVDT). In some embodiments, a flexible bellows 20 protects the armature 17 and/or the sensor body 18. The bellows 20 can be filled with oil, for example, to facilitate pressure-balancing. The sensor body 18 can also be coupled to a second mount block 22. In some cases, one or more of the mount blocks 12, 22 include one or more ports 30. As illustrated, the first mount block 12 and the second mount block 22 need not be the same size or shape. Generally, the components of the sensor assembly 10 are constructed of long life corrosion resistant materials, such as but not limited to Monel 400, Monel 500, Inconel 625, Super Duplex Steels, stainless steel, aluminum, or otherwise.

Figure 13:
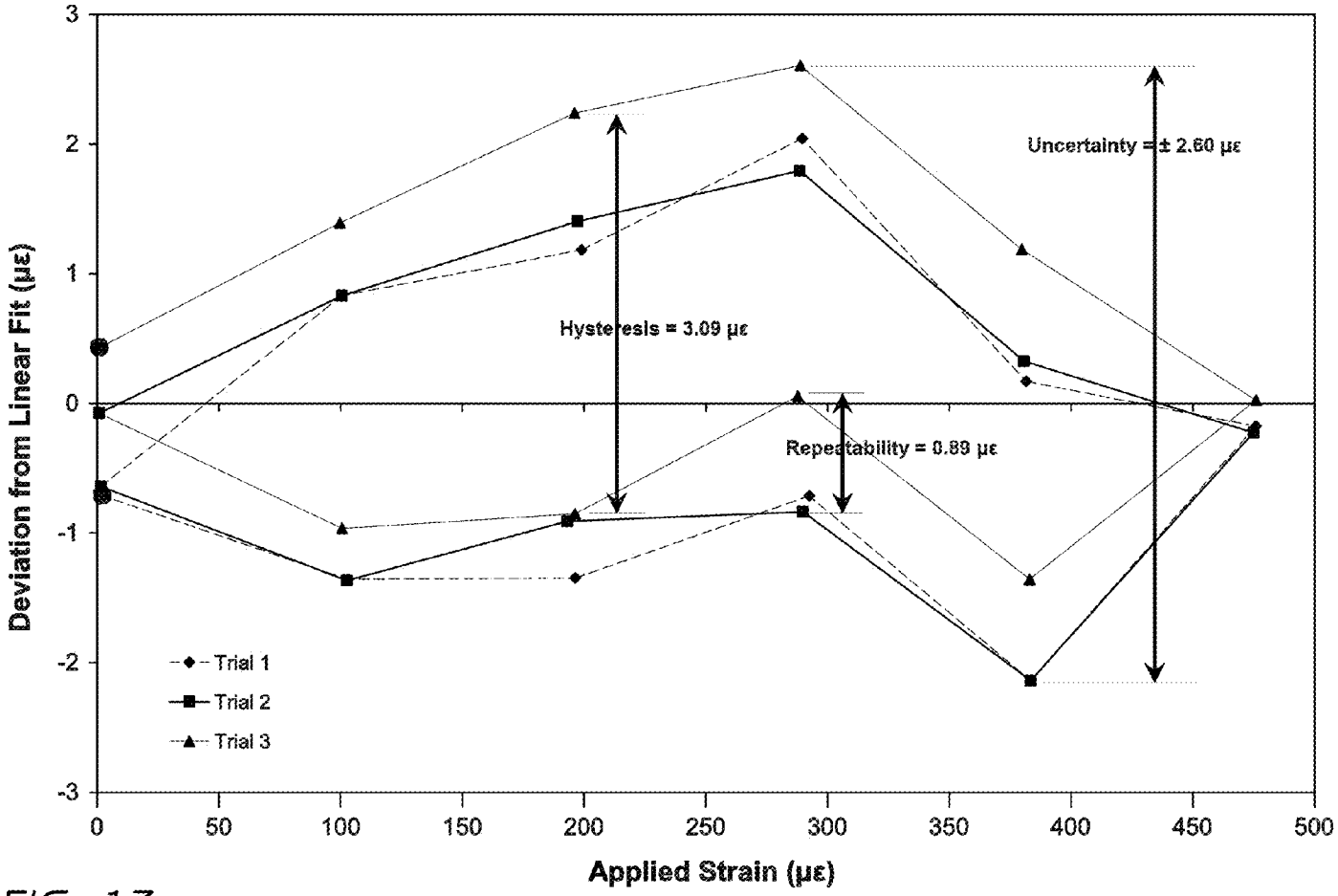
FIG. 13 illustrates a chart of three non-limiting embodiments of empirical strain testing values.

In some embodiments, the first mount block 12 is rigidly connected to a first location of a tubular member (not shown) and the second mount block 22 is rigidly mounted to a second location of the tubular member, e.g., on opposing sides of a weld in the tubular member. As discussed above, the first mount block 12 connects to one end of the armature 17 (via the spacer bar 14); the second mount block 22 connects to the sensor body 18, which in turn interfaces with a second end of the armature 17. Thus, by measuring the displacement of the armature 17 relative to the sensor body 18, the sensor 19 can measure the relative displacement of the mount blocks 12, 22 and/or the relative displacement of the first and second locations of the tubular member. Such relative displacements can be used to determine, for example, strain in the tubular member. In some instances, the strain that is measured, read, or determined is at least partly non-linear and can include other factors, such as uncertainty, hysteresis, and repeatability. For example, FIG. 13 shows three trials illustrating deviation from linear fit as a function of applied strain.

In certain embodiments, one or more of the mount blocks 12, 22 can be coupled to a vertically extending member 24, also called a "top hat." Each vertically extending member 24 can include a cylindrical portion 23 connected to a radially inwardly-extending shoulder 27, which in turn connects to an axial passage 25 (not shown) that is configured to receive a fastener 26 (only the top of the fastener is shown), such as a screw. As illustrated, one or more of the vertically extending members 24 can include a notch 28.

Figure 2:
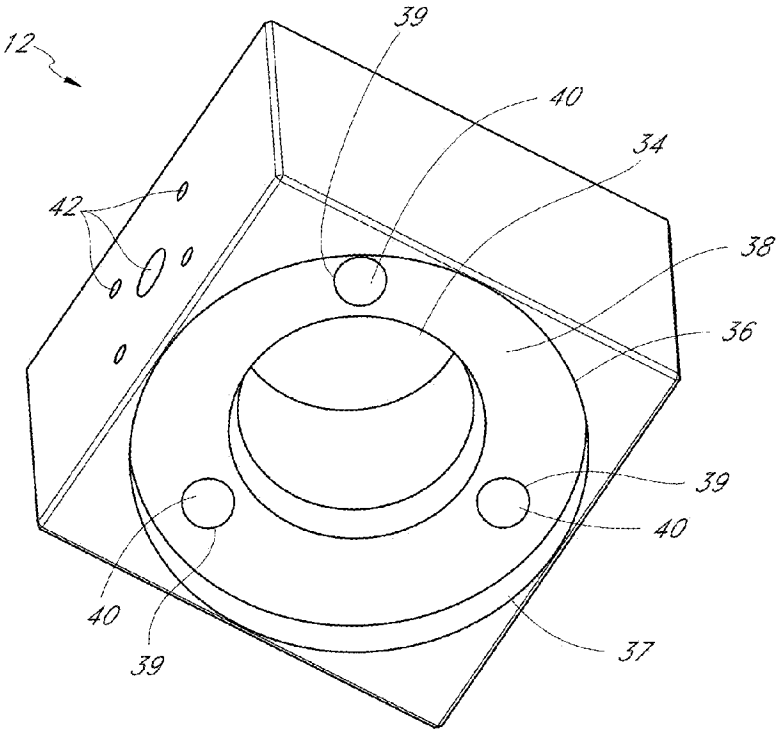
FIG. 2 illustrates an isometric view of an embodiment of a mount block.

Turning to FIG. 2, an embodiment of the first mount block 12 is illustrated. Generally, the second mount block 22 can include similar or the same features and aspects as the first mount block 12. As shown in FIG. 2, the first mount block 12 is rectangular, but it can be most any other shape. As shown, one or more surfaces of the first mount block 12 can include a recessed portion 36, which in turn can include a wall portion 37 and a radially-inwardly extending first positioning face 38. An aperture 34 through the first mount block 12 can connect with the recessed portion 36. As shown, the aperture 34 and recessed portion 36 are each about circular in cross-section, though many other shapes are possible.

In some embodiments, the first positioning face 38 includes one or more first locating features 39, e.g., grooves or recesses of various shapes and sizes, for receiving one or more positioning elements 40 of various shapes and sizes (e.g., press-fit, slip-fit, snap-fit, detent, threads, or the like). For instance, the embodiment shown includes three cylindrically-shaped first locating features 39 configured to receive three substantially spherical or hemispherical positioning elements 40. The first locating features 39 can be the same shape or different shapes. Likewise, the positioning elements can be the same shape or different shapes to correspond or align with the shapes of the first locating features 39. As shown, the first locating features 39 and positioning elements 40 are positioned about equidistant from each other in a circumferential axis about the aperture 34 and about radially equidistant from a longitudinal axis of the aperture 34, though many alternate arrangements of the first locating features and elements 39, 40 are possible. One or more surfaces of the first mount block 12 can also include one or more fastening features 42 for, e.g., coupling to other components of the sensor assembly. The fastening features 42 can be of different sizes and shapes. For instance, the illustrated embodiment includes five fastening features: four small fastening features spaced around a large central fastening feature.

Figure 3:
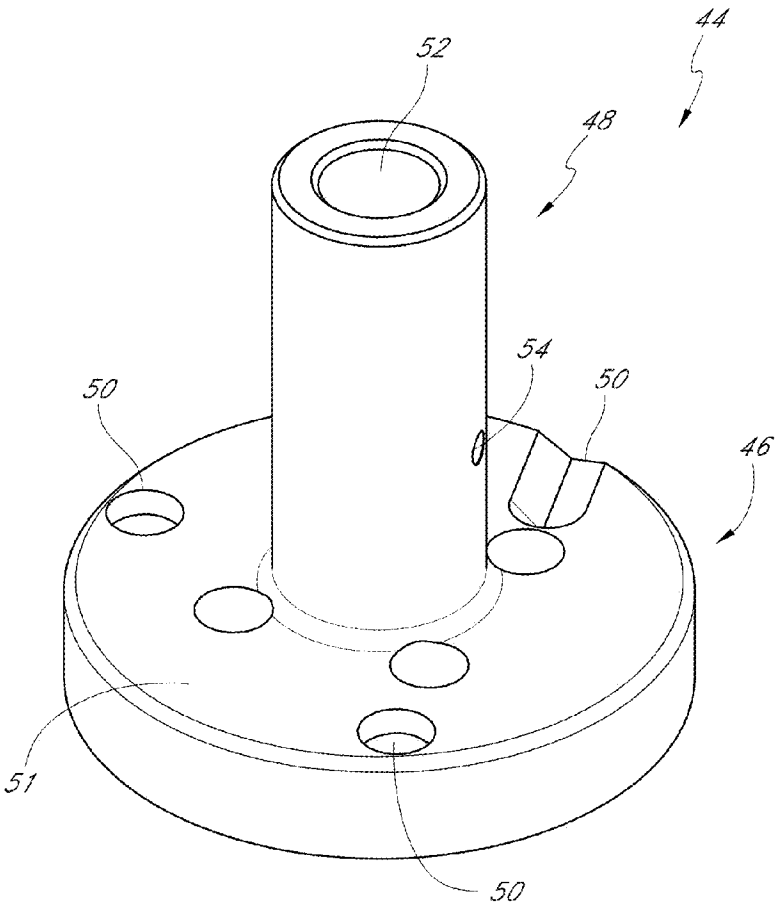
FIG. 3 illustrates an isometric view of an embodiment of an alignment post.

An embodiment of a portion of an alignment post 44 is illustrated in FIG. 3. Typically, the alignment post 44 is joined with the tubular member in specific locations on the tubular member. For example, the alignment post 44 can be joined with the tubular member with extension portions that project radially outward from the tubular member (see, e.g., FIG. 9). In other instances, the alignment is post 44 is radially adjacent, or flush with, the outer surface of the tubular member (see, e.g., FIG. 9B).

As shown in FIG. 3, the alignment post 44 can include a base 46 with a tubular section 48 extending therefrom. The base 46 can be sized and shaped to mate with the recessed portion 36 of the mount block 12 and the tubular section can be sized and shaped to be received by the aperture 34. Generally, to facilitate mating and positioning, the tubular section 48 is tapered and the bottom edge of the aperture 34 is correspondingly tapered. A conduit 52 can extend through at least some of the tubular section 48. In certain embodiments, the conduit 52 is threaded. In some arrangements, the tubular section 48 includes one or more slots 54 (e.g., holes, recesses, notches, grooves, or cut-out areas), as will be discussed in further detail below. The base 46 can include a second positioning face 51, which can have one or more second locating features 50 of various shapes and/or sizes. The second locating features 50 can be the same shape or can be of different shapes. For example, the embodiment illustrated includes second locating features 50 that are a cylindrical recess, a conical recess, and an elongated valley.

Generally, the second locating features 50 are positioned in a manner similar to the first locating features 39 of the first mount block 12. In some embodiments, when the alignment post 44 and the first mount block 12 are mated, the first positioning element 40 and the second locating feature 50 (and/or the first and second locating features 39, 50) are aligned. Thus, in certain such embodiments, the first positioning element 40 can be received in the second locating feature 50.

In some implementations, the alignment post 44 is installed at a predetermined point on a tubular member prior to the tubular member being submerged. Thus, as will be discussed in further detail below, the alignment post 44 can facilitate locating the sensor assembly 10 (via the mount blocks 12, 22) at the predetermined points on the tubular member, even when the tubular member is positioned at or near the sea floor. Many ways can be employed to connect the alignment post 44 to the tubular member, including, without limitation, welding, fasteners, glue, epoxy, clamps, straps, or the like. In some embodiments, the alignment post 44 connects to insulation on the tubular member, such as is disclosed in U.S. Patent Application Publication No. 2008/0303382, the entirety of which is incorporated by reference herein. Further, some embodiments of the alignment post 44 include an extension member to distance the alignment post 44 from the surface of the tubular member.

Figure 4:
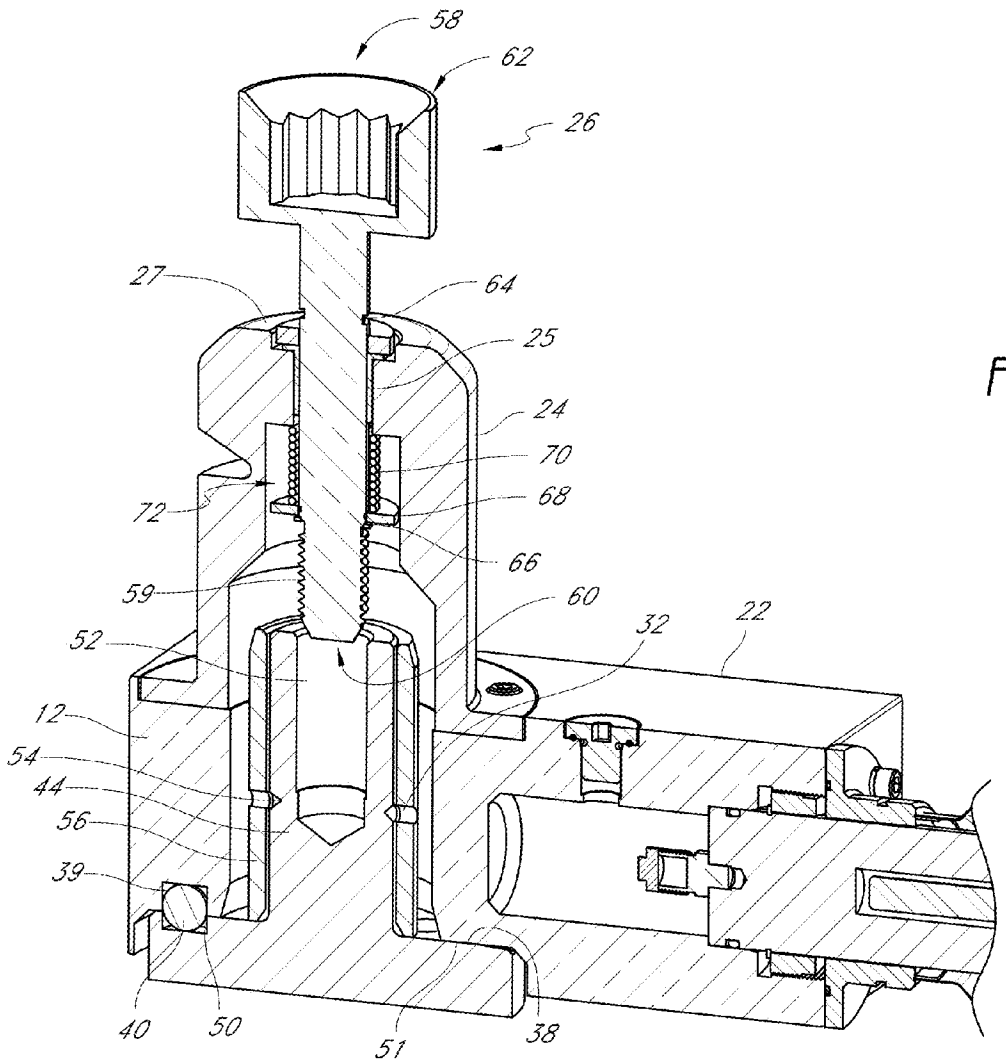
FIG. 4 illustrates a longitudinal cross-sectional view of the sensor assembly of FIG. 1 installed with the alignment post of FIG. 3 and an embodiment of a spool, wherein the fastener is in the "full out" position.

With regard to FIG. 4, a cross-section of an embodiment of the sensor assembly 10 with the fastener 26 in the "full out" position is depicted. The alignment post 44 is received by a spool 56, which in turn is received by the first mount block 12. In some embodiments, the alignment post 44 is received by the first or second mount 12, 22 without a spool 56. As shown, the spool 56 can include slot, recesses, gaps, apertures or holes 32 that are positioned to correspond to the slots 54 in the alignment post 44. In some cases, set screws are used to connect the spool 56 and the alignment post 44 via the holes 32 and slots 54. In some embodiments, the alignment post 44 and/or the spool 56 are tapered to facilitate precise alignment with one of the mount blocks 12, 22.

In certain implementations, the first and second mount blocks 12, 22 each are configured to couple with of the alignment posts 44. For example, the first positioning face 38 of the first mount block 12 can abut or otherwise engage with the second positioning face 51 of the base 46 of the alignment post 44. In the embodiment shown, the positioning element 40 is located between the first and second locating features 39, 50. In some embodiments, when the mount block 12 and the base 46 are engaged, the alignment post 44 is configured to engage the fastener 26. For example, the conduit 52 of the alignment post 44 can be configured to be coaxial with, or about coaxial with, the axial passage 25 of the vertically extending member 24.

In some embodiments, the fastener 26 includes a proximal end 58, a threaded portion 59, and a distal end 60. The proximal end 58 generally includes a radially-outwardly extending head portion 62. Most any type of configuration for the head portion 62 can be employed, such as slotted, Phillips, square, Torx, hex, or the like. In some embodiments, the head portion 62 includes a socket-head with six, eight, ten, or more lobes. The fastener 26 can include a flare or cone configured to facilitate guiding an implement into the head portion 62. The fastener 26 can include indicia 64, such as a reduced-diameter section or indelible marking, spaced along the fastener 26 such that the indicia 64 is visible between the head portion 62 and the inwardly-extending shoulder 27 when the fastener 26 is not received by the alignment post 44. In some embodiments, the fastener 26 includes a radially-outwardly extending flange 66. A retaining ring 68 can be connected to the fastener 26 and abut the flange 66. In other cases, the fastener 26 includes a groove, slot, or recess (not shown) configured to receive the retaining ring 68. As shown in FIG. 4, in some embodiments, a biasing member 70 (e.g., a spring or belleville washer) generally biases the fastener 26 away from the inwardly-extending shoulder 27, which can facilitate threading the fastener 26 into the alignment post 44. As shown, the fastener 26, biasing member 70, retaining ring 68, and flange 66 are at least partly contained within an axial chamber 72 of the vertically extending member 24.

Figure 5:
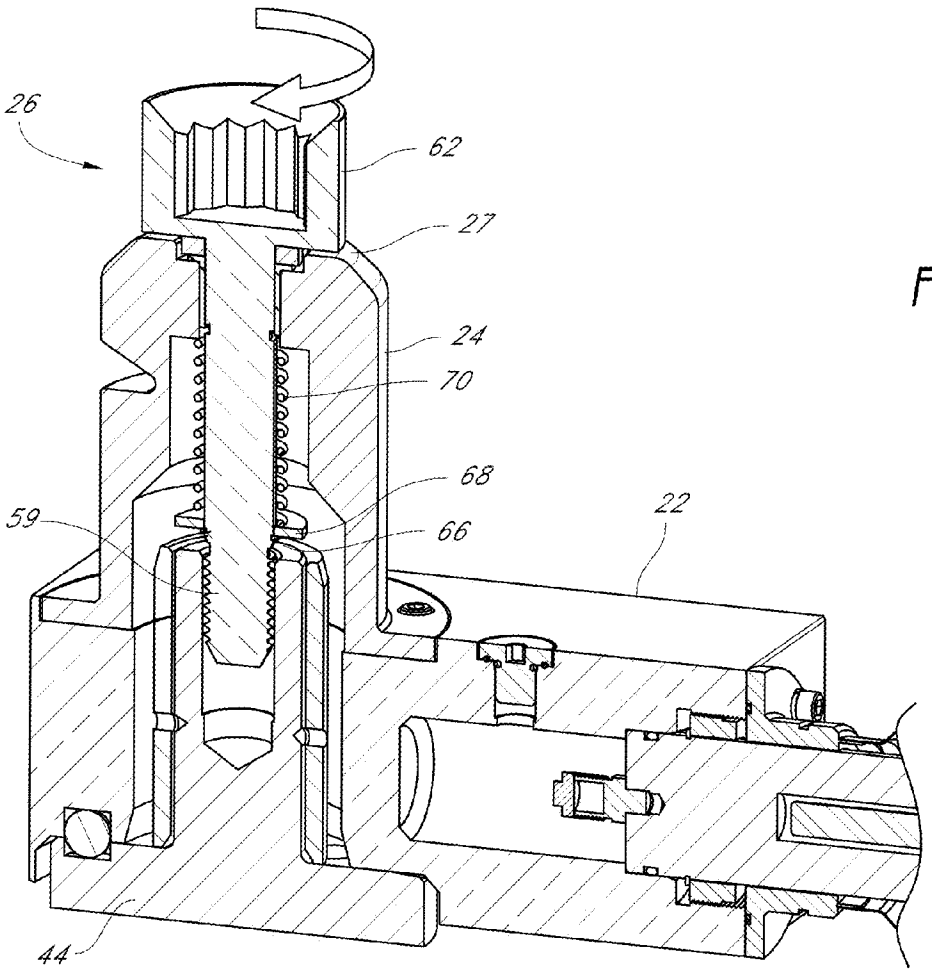
FIG. 5 illustrates a longitudinal cross-sectional view of the sensor assembly of FIG. 1 installed with the alignment post of FIG. 3 and an embodiment of a spool, wherein the fastener is in the "full in" position.

With regard to FIG. 5, a cross-section of an embodiment of the sensor assembly with the fastener 26 in the "full in" position is depicted. In this position at least a portion of the threaded portion 59 of the fastener 26 is received in the alignment post 44. As shown, the head portion 62 is in contact or about in contact with the inwardly-extending shoulder 27 of the vertically extending member 24, the biasing member 70 has been extended, and the flange 66 and the retaining ring 68 are in contact or about in contact with an upper end of the alignment post 44 and/or the spool 56.

Figure 6B:
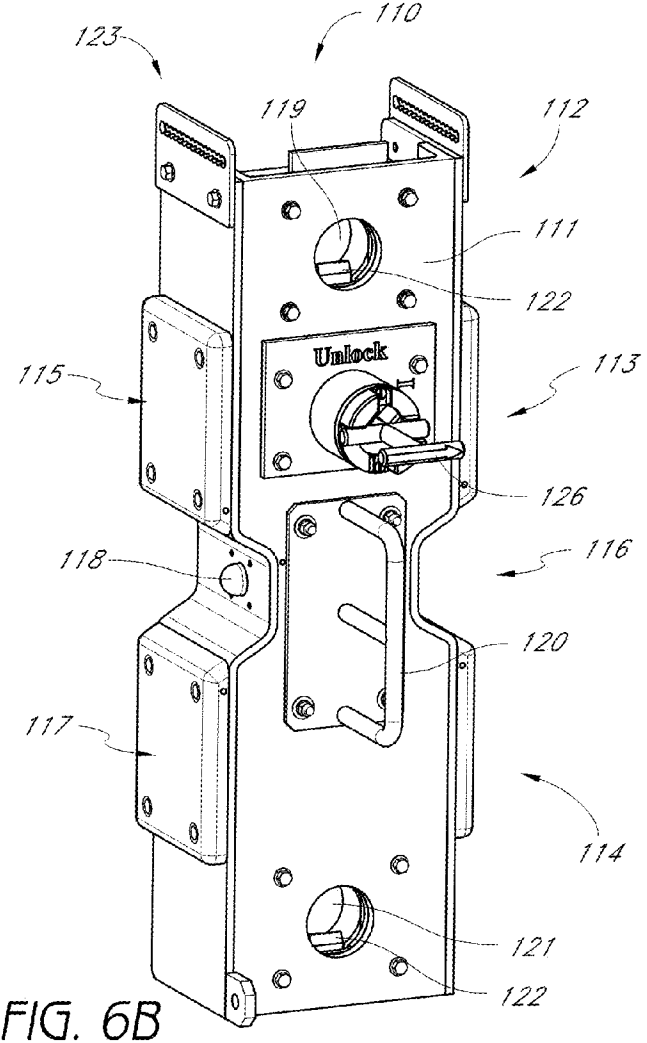
FIGS. 6A-6B illustrate front and back isometric views of an embodiment of an alignment tool.
Figure 6A:
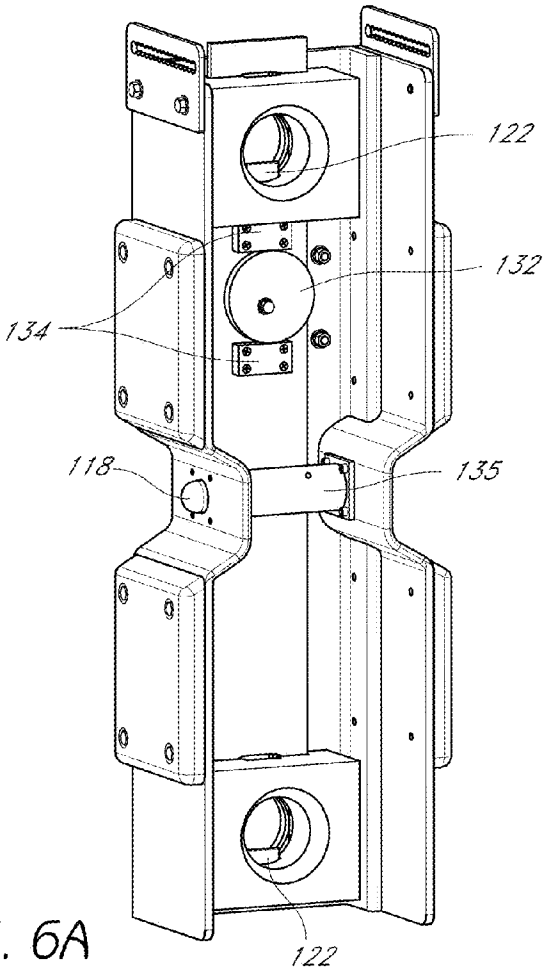

Turning now to FIGS. 6A-6B, illustrated is an embodiment of the alignment tool 110. The alignment tool 110 includes a deck 111 connecting a first wall 113 and a second wall 115. As shown, in some embodiments, in plan view the alignment tool 110 is about hourglass in shape: having wider upper and lower sections 112, 114 and a narrower guide channel 116 therebetween. The alignment tool 110 can be of various shapes and sizes such as angular, rectangular, square, or round Likewise, the walls 113, 115 and the deck 111 can be of various sizes and shapes. Low friction pads 117 can be connected to at least a portion of some of the walls 113, 115 and/or the guide channel 116.

Some embodiments of the alignment tool 110 include a first positioning feature 118. The first positioning feature 118 can be located in the guide channel 116. For example, some embodiments include a spring within a hollow tube 135 disposed between the sides 113, 115, the spring biasing hemispherical detents projecting into the first positioning feature 118. The first positioning feature 118 can be of various shapes, such as ball, sphere, cylindrical, or wedge-shaped. The first positioning feature 118 can include a feature, such as a visual or an electrical signal, to indicate that the first positioning feature 118 has been engaged.

Certain implementations of the alignment tool 110 include a handle 120 to facilitate, e.g., manipulation, alignment, positioning, installation and/or placement of the alignment tool 110. As shown, the handle 120 is positioned generally centered on the alignment tool 110. In other embodiments, the handle 120 is positioned in alternate locations on the alignment tool 110. The upper and/or lower sections 112, 114 can include openings 119, 121 configured to receive the vertically extending member 24 of each respective mounting block 12, 22 of the sensor assembly 10. In some embodiments, one or both of the openings 119, 121 include one or more latch elements 122, as will be discussed in further detail below. In certain arrangements, the alignment tool 110 includes one or more grips 123 to facilitate, for example, transporting the alignment tool 100 and/or tethering the alignment tool to a desired location.

Figure 7:
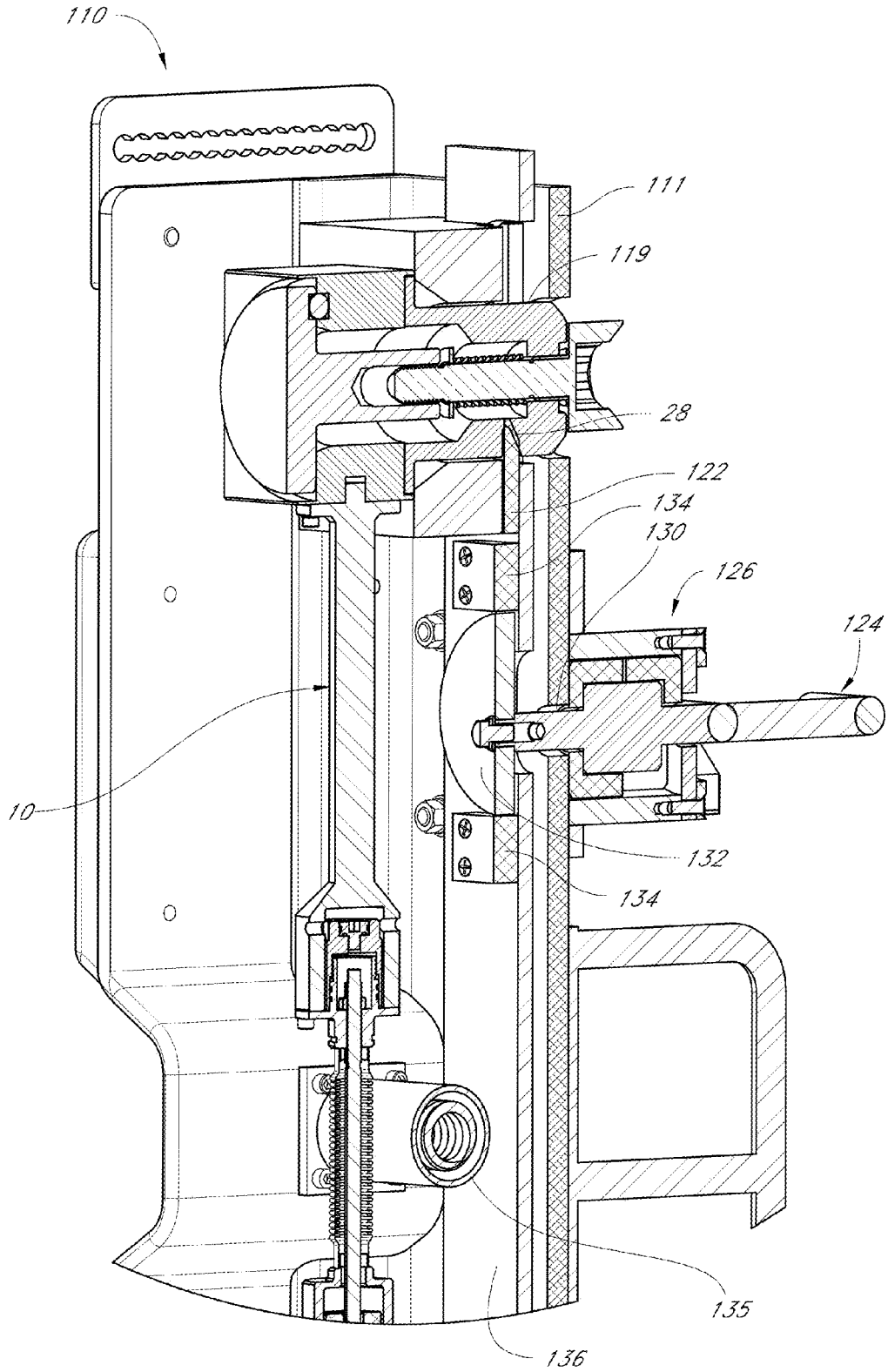
FIG. 7 illustrates a partial longitudinal cross-sectional view of the alignment tool of FIGS. 6A-6B installed with the sensor assembly of FIG. 1.

With regard to FIG. 7, an example of the engagement between the sensor assembly 10 and the alignment tool 110 is illustrated. In some embodiments, a lever 124 connects to the deck 111 and/or one or more of the walls 113, 115 by a mount 126. The lever 124 can pass through a gap 130, aperture, recess, opening or the like in the deck 111. In certain embodiments, the lever 124 is coupled with a cam 132 by, e.g., a screw, snap ring, or the like. The cam 132 can contact one or more tappets 134, which in turn are connected to a translation member 136. The translation member 136 can extend a portion of the distance between the openings 119, 121. In certain embodiments, the translation member 136 connects to one or more of the latch elements 122, e.g., the ends of the translation member 136 each connect to one of the latch elements 122. As shown, when the sensor assembly 10 and alignment tool 110 are engaged (e.g., assembled, mated, mounted, installed or the like), the notch 28 of the vertically extending member 24 can be axially aligned, substantially axially aligned, or about axially aligned with the latch element 122.

In certain embodiments, when the sensor assembly 10 and alignment tool 110 are engaged, a locked position of the alignment tool 110 and sensor assembly 10 can be achieved by rotating the lever 124 (e.g., about 90° clockwise). Such movement of the lever 124 can in turn rotate the cam 132 by a similar amount. The rotational movement of the cam 132 can be transformed to linear movement of the tappets 134, as well as linear movement of the translation member 136. Such movement of the translation member thereby encourages the one or more latch elements 122 toward the openings 119, 121. Indeed, as discussed above, when the sensor assembly 10 and alignment tool 110 are engaged, the latch elements 122 and the notch 28 are aligned. Thus, rotation of the cam 132 can move the one or more latch elements 122 into an extended position, e.g., into the notch 28. In some embodiments, the latch element 122 and/or the notch 28 is radiused, beveled, or the like, to facilitate guiding the latch element 122 into the notch 28. As illustrated, in a mode in which the openings 119, 121 receive the vertically extending member 24 of the sensor assembly 10, the extended position of the latch element 122 can place the latch element 122 in engagement with the notch 28 and thereby secure, lock, or hold together the sensor assembly 10 with the alignment tool 110.

With continued reference to the embodiment of FIG. 7, the alignment tool 110 can be placed in an unlocked or retracted position by rotating the lever 124 in the opposite direction from that used to achieve the locked or extended position (e.g., about 90° clockwise). Such rotation rotates the cam 132 by a similar amount, thereby translating the tappets 134 and translation member 136 and moving the latch element 122 to a retracted position, in which the latch element 122 is disengaged from the notch 28. Generally, the one or more latch elements 122 are biased to return to the retracted position. In some such embodiments, the disengagement of the latch element 122 from the notch 28 facilitates the disengagement or removal of the mounting alignment tool 110 from the sensor assembly 10 by de-mating the alignment tool 110 from the sensor assembly 10.

Figure 8B:
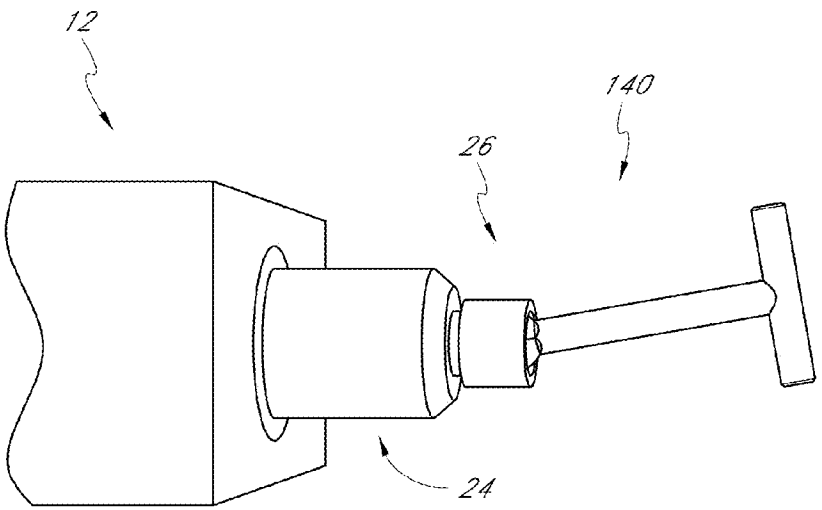
FIGS. 8A-8B illustrate an embodiment of a wrench.
Figure 8A:
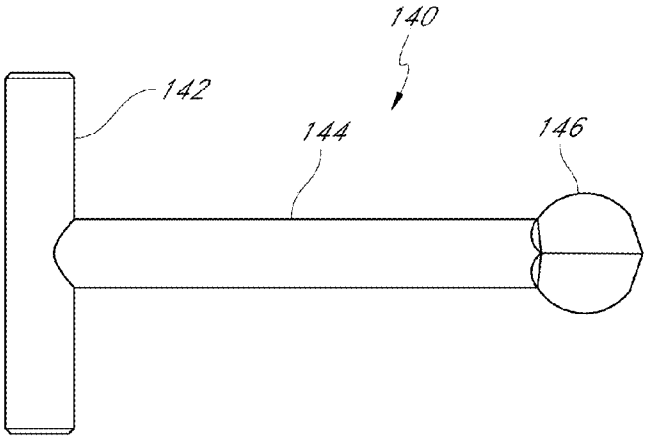

Turning to FIGS. 8A-8B, an embodiment of a wrench 140 can include a handle section 142, an elongate section 144, and a head section 146. The wrench 140 can be configured to be coupled to the head portion 62 of the fastener 26. Accordingly, the head section 146 can be configured to be matingly-received by the head portion 62. As shown, the head section 146 can be a hexagonally-faceted generally spherical element, which can allow insertion of the wrench into the head portion 62 at multiple angles. The wrench 140 can include an aperture, hook, or the like configured to receive a tether (such as a lanyard) that can be coupled to the sensor assembly 10, ROV, tubular member or alignment tool 110 to inhibit the wrench 140 from falling to the sea floor should the wrench 140 be dropped. In some embodiments, the wrench 140 is stored within a storage feature (not shown) on the alignment tool 110. For example, the alignment tool 110 can include a hook, clamp, basket, magnet or the like, for storage of the wrench 140.

Figure 9:
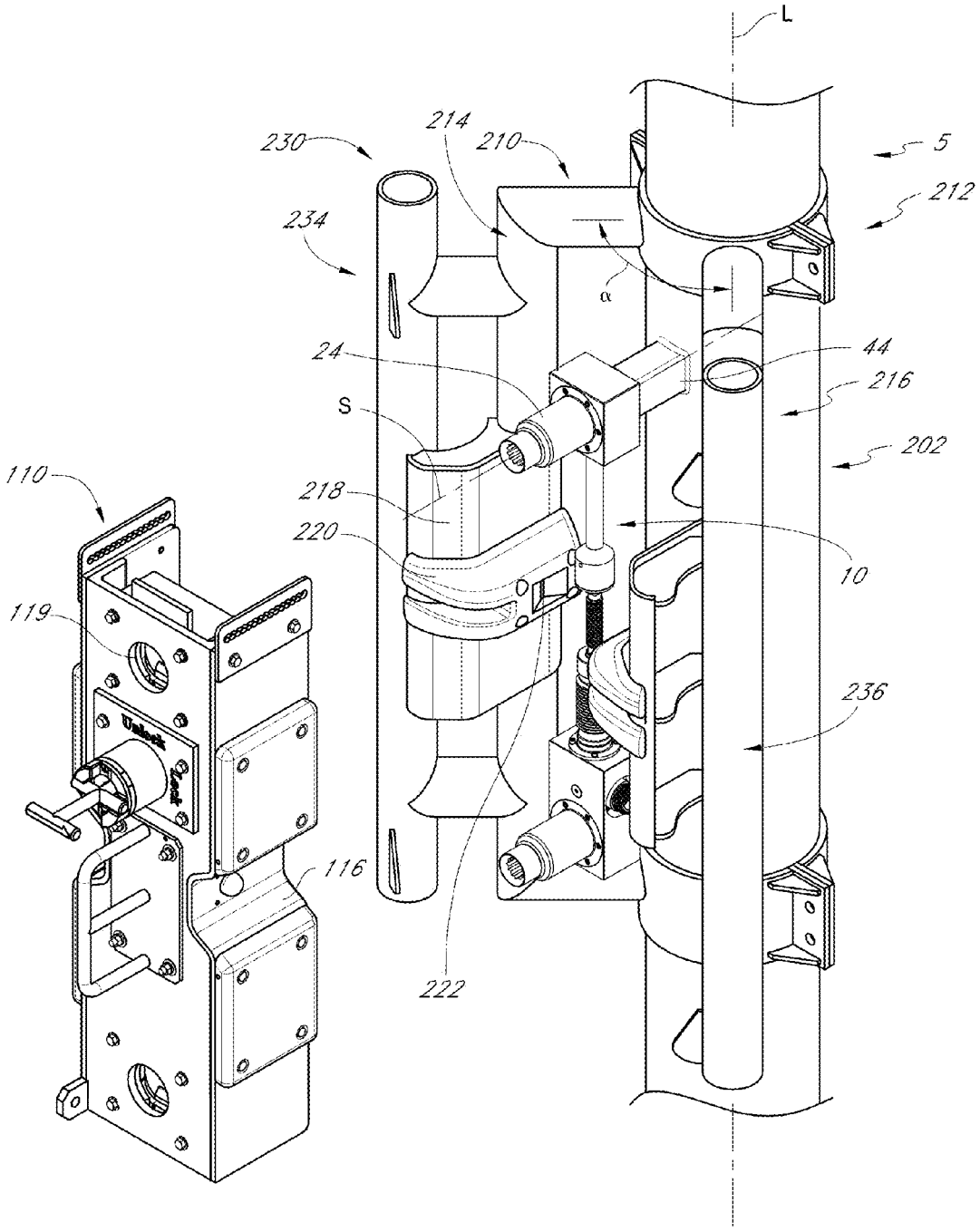
FIG. 9 illustrates an isometric view of an embodiment of a tubular member coupled with the sensor assembly of FIG. 1, an embodiment of an alignment cage, and an embodiment of a protection cage, and also illustrates the alignment tool of FIGS. 6A-6B in a disengaged position.

With reference to FIG. 9, an embodiment of the subsea strain sensor assembly 5 in a pre-assembled state on a tubular member 202 is illustrated. As shown, the subsea strain sensor assembly 5 can connect to a tubular member 202. In certain embodiments, the subsea strain sensor assembly 5 includes the sensor assembly 10, alignment tool 110, and the alignment cage 210. In some arrangements, the subsea strain sensor assembly 5 also includes a protection cage 230.

In some instances, one or more alignment posts 44 couple the sensor assembly 10 with the tubular member prior 202. For example, the alignment posts 44 can be installed on (e.g., via welding or bonding technique) the tubular member 202 prior to the tubular member being submerged. As discussed above, the alignment posts 44 can also be installed on an insulation member on the tubular member or include an extension member that is installed on the tubular member.

In certain implementations, the protection cage 230 and alignment cage 210 connect to the outside of the tubular member 202, such as by a bracket 212. In some arrangements, the protection cage 230 and alignment cage 210 connect to a common bracket 212. In other arrangements, the protection cage 230 and alignment cage 210 connect to different brackets (see FIG. 9B). In some implementations, the bracket 212 is configured to connect to the outside of the tubular member 202 with sufficient force to inhibit the protection cage 230 and the alignment cage 210 from moving relative to the tubular member 202 when the tubular member 202 is in an upright position. Various methods can be used to connect the bracket 212 to the tubular member, such as by welding, clamps, flanges, fasteners, press-fit, or the like. The bracket 212 can include a cut-out portion (see FIG. 9B) configured to mate to a boss (not shown) on the tubular member, thus inhibiting the bracket 212, protection cage 230 and/or alignment cage 210 from rotating relative to the tubular member 202. Thus, the position of the bracket 212, protection cage 230, and alignment cage 210 relative to the tubular member 202 can be maintained, even in instances in which a force is applied to the protection cage 230 and/or alignment cage 210, such as can occur during ROV operations in the vicinity of the subsea strain sensor assembly 5.

In some embodiments, the protection cage 230 and/or alignment cage 210 are rigidly connected to the tubular member 202 at only one end. Among other advantages, such a configuration can avoid transferring tubular member loads (e.g., bending and/or tension) through the protection cage 230 or alignment cage 210. For example, in the embodiment shown, the bracket at the upper end of the alignment cage 210 is rigidly connected to the tubular member 202 and the bracket at the lower end of the alignment cage 210 is non-rigidly connected to the tubular member 202. In some arrangements, the transfer of tubular member loads to the alignment and/or protection cage(s) 210, 230 is inhibited by an isolator (e.g., a material with a low Modulus of Elasticity) disposed at the interface of the tubular member 202 with the alignment and/or protection cage 210, 230. For example, in some embodiments, both ends of the protection cage 230 and/or alignment cage 210 are clamped to the tubular member 202 with a bracket having a rubber surface, so that load in the tubular member deforms the rubber rather than being transferred to the cage(s).

As shown, the alignment cage 210 includes first and second alignment cage arms 214, 216, which can be disposed at an angle $\alpha$ with respect to each other around the longitudinal axis L of the tubular member 202. As shown, angle $\alpha$ is about 90°, though most any angle is possible. Generally, the first and second alignment cage arms 214, 216 are about equally spaced from the sensor assembly 10 mounted to the tubular member 202.

As illustrated, one or more of the first and second alignment cage arms 214, 216 can include an alignment guide section 218, which can include an alignment rib 220. The alignment rib 220 can be disposed generally parallel to the longitudinal axis S of the vertically extending members 24 of the sensor assembly 10. The alignment rib 220 can include low friction pads or coatings to facilitate assembly, mounting, or installation of the alignment tool 110 with the alignment cage 210 and/or sensor assembly 10, as discussed below. In some embodiments, the alignment rib 220 includes a second positioning feature 222, e.g., a recess, to mate with the first positioning feature 118 of the alignment tool 110. The alignment guide section 218 is disposed along the axis L so as to receive the guide channel 116 of the alignment tool 110. The alignment guide section 218 is generally equally spaced between the first and second mount blocks 12, 22 of the sensor assembly 10. In some embodiments, by virtue of the alignment guide section 218 being received in the guide channel 116, results in the extending members 24 of the sensor assembly 10 being automatically aligned with the respective openings 119, 121 of the alignment tool 110 to facilitate removal and installation of the sensor assembly 10.

Figure 9A:
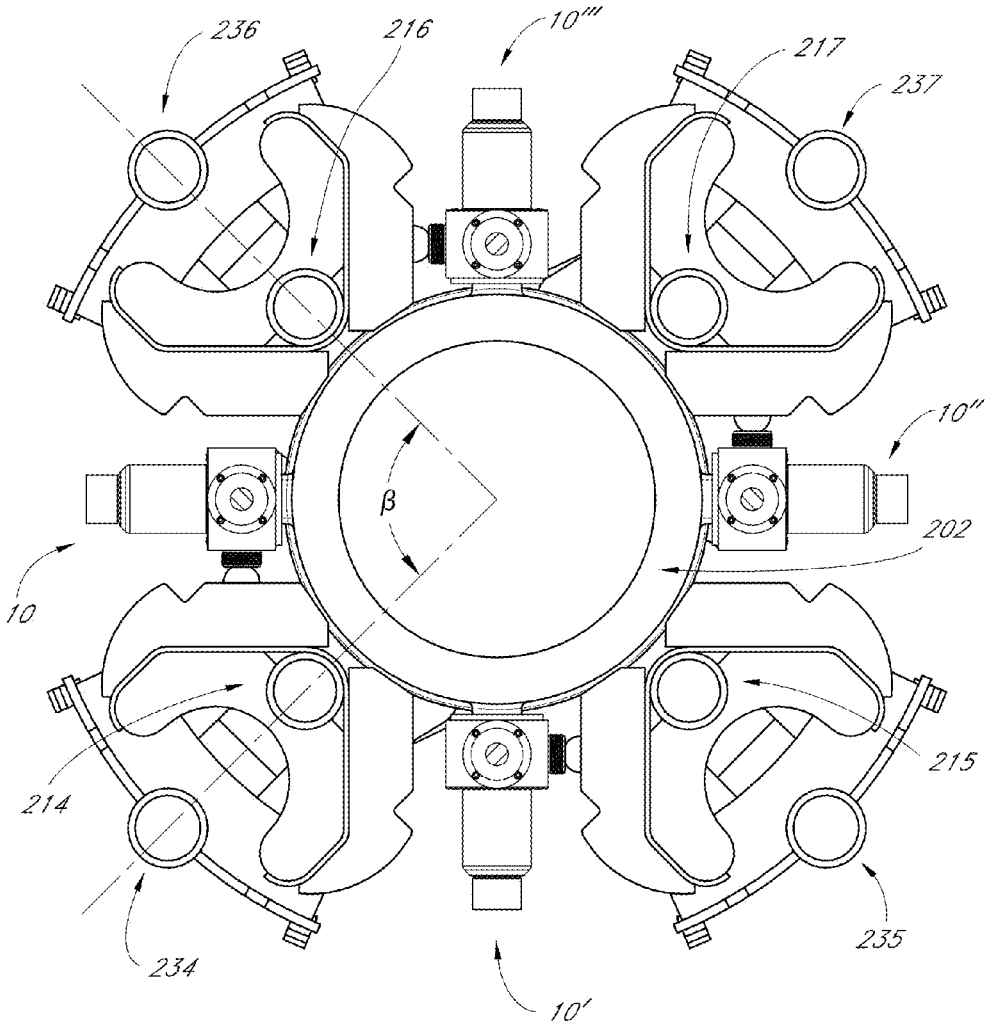
FIG. 9A illustrates an axial cross-sectional view of the tubular member of FIG. 9 wherein the tubular member is coupled with multiple sensor assemblies, alignment cages, and protection cages.
Figure 9B:
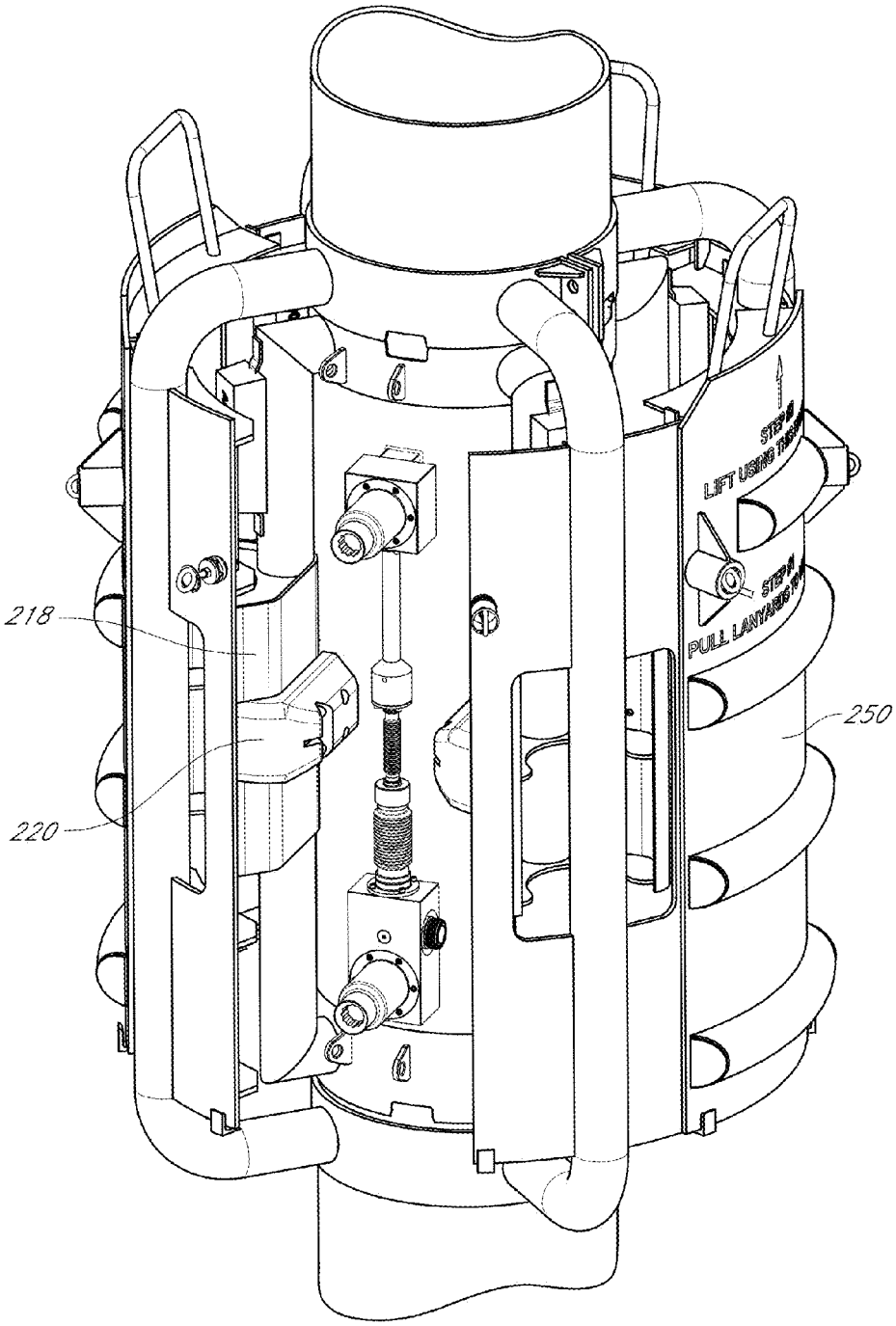
FIG. 9B illustrates a perspective view of the tubular member of FIG. 9A and including protective doors.

With regard to FIG. 9A, the protection cage 230 can include first and second protection cage arms 234, 236 which can be disposed at an angle 13 with respect to each other around the longitudinal axis L of the tubular member 202. As shown, the first protection cage arm 234 can be external to and about radially in-line with the first alignment cage arm 214, and the second protection cage arm 236 can be external to and about radially in-line with the second alignment cage arm 216. As such, the protection cage arms 234, 236, can protect the alignment cage arms 214, 216 (as well and the sensor assembly 10 and alignment posts 44) from damage. In certain implementations, the protection cage 230 includes a casing, such as a door, that can be moved (e.g., swung radially and/or translated longitudinally) or removed to permit access to the sensor assembly 10. For example, as shown in FIG. 9B, the protection cage 230 can include at least one door 250 or other type of outer protective barrier. In some embodiments, a plurality of doors 250 can also be arrayed or arranged on the tubular member 202 for each of the protection cages 230 arrayed on the tubular member 202. The plurality of doors 250 can be disposed around the circumference of the tubular member 202, for example, to align with the protection cage arms 234-237 and permit access to the sensor assemblies 10, 10', 10", and 10''', respectively. The door can include a window, latch, handle, and/or signaling indicia.

A plurality of alignment posts 44, sensor assemblies 10, protection cages 230, and alignment cages 210 can be arrayed on the tubular member 202. For example, FIG. 9A illustrates a tubular member with four sets of alignment posts 44 and sensor assemblies 10, which are disposed about 90° from each other around the circumference of the tubular member 202. Many other arrangements of alignment posts 44 and sensor assemblies 10 around the circumference of the tubular member are possible, such as two, three, five, six, or more alignment posts 44 and sensor assemblies 10. Generally, the sensor assemblies 10 are equally spaced-apart around the circumference of the tubular member 202; however non-equal spacing is employed in certain embodiments. Further, alignment posts 44 and sensor assemblies 10 can be arrayed along the longitudinal axis L of the tubular member 202.

Each sensor assembly 10 can be flanked by a protection cage 230 and alignment cage 210. In some cases, such as in the embodiment of FIG. 9A, the protection cages 230 share protection cage arms 234-237 and the alignment cages 210 share alignment cage arms 214-217. As illustrated, sensor 10 is flanked by protection cage arms 234, 236 and alignment cage arms 214, 216; sensor 10' is flanked by protection cage arms 234, 235 and alignment cage arms 214, 215; sensor 10" is flanked by protection cage arms 235, 237 and alignment cage arms 215, 217; and sensor 10''' is flanked by protection cage arms 236, 237 and alignment cage arms 216, 217. Such sharing of alignment and/or cage arms can, for example, reduce the size, weight, and/or expense of the subsea strain sensor assembly 5. In certain implementations, the alignment cage arms 214, 216 and the protection cage arms 234, 236 are separate (e.g., not connected to each other and/or include a dampener therebetween). Such a configuration can, for example, inhibit or prevent an impact to the protection cage 230 from displacing or damaging the sensor assembly 10 and/or the alignment cage 230. Such damage or displacement could, for example, disturb the relative positioning of the alignment cage 230 and the sensor assembly 10, which in turn could inhibit mating with the alignment tool 110 and/or could inhibit the sensor assembly 10 from being accessed and serviced (e.g., removed and replaced).

In some embodiments, portions of the subsea strain sensor assembly 5 are configured to be brought to the surface when not in use. For instance, some arrangements of the alignment tool 110 are configured to be lowered to desired depth and returned to the sea surface when an alignment operation is completed. In other embodiments, one or more components of the subsea strain sensor assembly 5 are maintained at a desired location along the tubular member 202. For instance, in some cases, an alignment tool 110 is maintained underwater at or near the subsea strain sensor assembly 5, so as to be conveniently located if needed. In some cases, the alignment tool is tethered to the protection cage 230, alignment cage 210, and/or the tubular member 202. The alignment tool 110 can include various sensors (e.g., depth sensor, pressure sensor, temperature sensor) and can be configured to communicate, via a wired or wireless connection, with another device, such as an ROV, a ship, the sensor 10, the alignment cage 210, etc.

Figure 10:
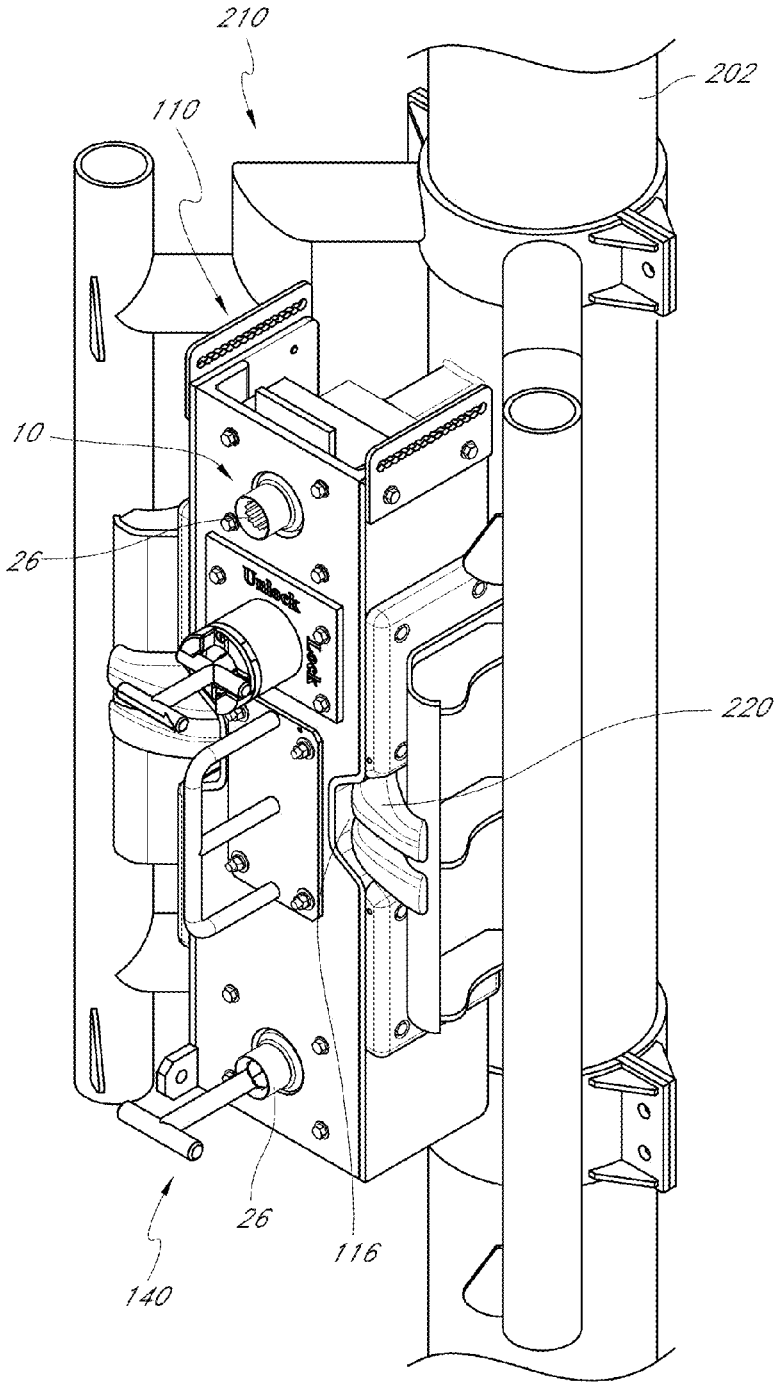
FIG. 10 illustrates an isometric view of an embodiment of the sensor assembly of FIG. 1 installed on a tubular member, with the alignment tool of FIGS. 6A-6B in an engaged position.

In certain configurations, such as the configuration shown in FIG. 10, the alignment cage 210 receives the alignment tool 110, which in turn receives the sensor assembly 10. In some such instances, the alignment tool 110 receives both ends of the sensor assembly 10 about concurrently, thus inhibiting displacement of the sensor 19 and/or kink in the mating of the alignment tool 110 with the sensor assembly 10.

As shown, the alignment rib 220 can be received in the guide channel 116, thereby mating the first positioning feature 118 with the second positioning feature 222. Generally, the mating of the first positioning feature 118 and second positioning feature 222 includes sufficient mating force so that the force of the weight of the alignment tool 110 does not separate the alignment tool 110 from the alignment cage 210. Thus, in some embodiments, the alignment tool 110 is held in the alignment cage 210 by the mating of the first and second positioning features 118, 222. Among other advantages, maintaining the alignment tool 110 in the alignment cage 210 by such mating can allow an ROV to release one feature (such as the handle 120) in order to grasp another feature (such as the wrench 140). Some arrangements of the alignment tool 110 can be latched to the sensor assembly 10 by, for example, the latching mechanism discussed above. As shown, the head portion 62 of the fastener 26 can protrude through the opening 119 and/or 121 thus permitting manipulation of the fastener 26, e.g., by the wrench 140.

Figure 11:
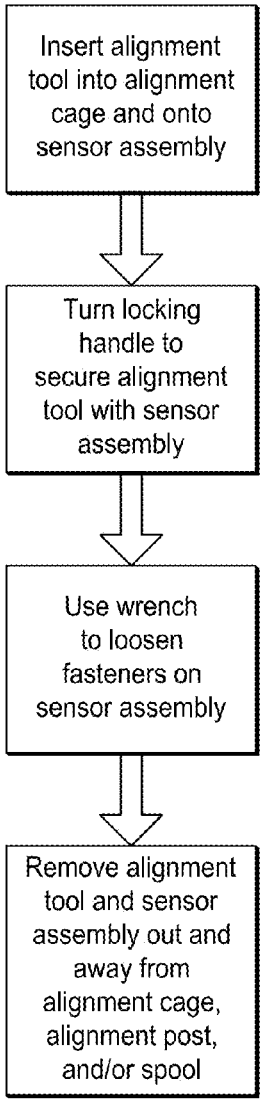
FIG. 11 illustrates an embodiment of a method of removing a sensor.

With regard to FIG. 11, an embodiment of a method of removing the sensor assembly 10 from a tubular member 202 is schematically illustrated. Such removal may be desirable when, for example, the sensor assembly 10, has failed or is in need of repair. The method can include inserting the alignment tool 110 into the alignment cage 210. In certain such embodiment, the alignment tool 110 receives the sensor assembly 10. In some embodiments, the alignment tool 110 can be aligned and inserted into the alignment cage 210 by using alignment features on the cage. For example, in some embodiments of the method, the guide channel 116 receives the alignment rib 220 of the alignment cage 210, thereby facilitating mating the alignment tool 110 with the sensor assembly 10.

In some embodiments, the method further includes locking, holding, latching, or otherwise securing the alignment tool 110 in the alignment cage 210 with positioning features on one or both of the alignment tool 110 and alignment cage 210, e.g., first and second positioning features 118, 222. In some embodiments, the method further includes mating a detent on the alignment tool 110 with a recess on the alignment rib 220.

Certain embodiments of the method of removing the sensor assembly include locking, holding, latching, or otherwise securing the alignment tool 110 to the sensor assembly 10. For example, in certain implementations, the alignment tool 110 is coupled with the sensor assembly 10 by one or more latches 122. In certain embodiments, the latches 122 are engaged by turning or rotating a locking handle or lever 124 (e.g., by 1/16, 1/8, 1/4, 3/8, 1/2, 5/8 3/4, 7/8, 1, 1 1/4, 1 1/2, 1 3/4, 2, 3, 4, 5, 6, 7, 8, 9, 10 turns, values in between, and otherwise). In some embodiments, as discussed above, the lever 124 can be coupled to a cam 132 which can contact one or more tappets 134 that are connected to a translation member 136. The translation member, in turn, can be connected to one or more latch elements 122. Thus, in some embodiments, the method can include rotating the lever 124 and translating the latch elements 122 into an extended position to be received by the notch 28 of the sensor assembly 10 and securing the alignment tool 110 to the sensor assembly 10.

Some embodiments of the method further include decoupling the sensor assembly 10 from the tubular member 202. For example, the method can include loosening the fasteners 26 (e.g., by 1, 2, 3, 4, 5, 6, 7, 8, 9, 10, 11, 12, 13, 14, 15 turns, values in between, and otherwise). In some embodiments, the decoupling (e.g., loosening the fastener 26) is accomplished with the wrench 140 and/or with an electric or hydraulic motor. In some embodiments, the wrench is manipulated by an ROV.

Some implementations of the method include removing the alignment tool 110 and sensor assembly 10 from the alignment cage 210, spool 56, and/or alignment post 44. For example, the alignment tool 110 and sensor assembly 10 can be separated from the alignment cage 210. In some such embodiments, the alignment tool 110 and sensor assembly 10 are brought to the sea surface. Certain embodiments can include removing the sensor assembly 10 from the alignment tool 110. Further implementations include removing the sensor 19 from the sensor assembly 10.

In some embodiments, all or certain portions of the method are accomplished with an ROV. For example, in some embodiments, the ROV inserts the alignment tool 110 into the alignment cage 210. In certain implementations, the ROV turns the locking handle or lever 124. In some variants, an ROV loosens the fastener 26. In some embodiments, an ROV removes the alignment tool 110 and sensor assembly 10.

Figure 12:
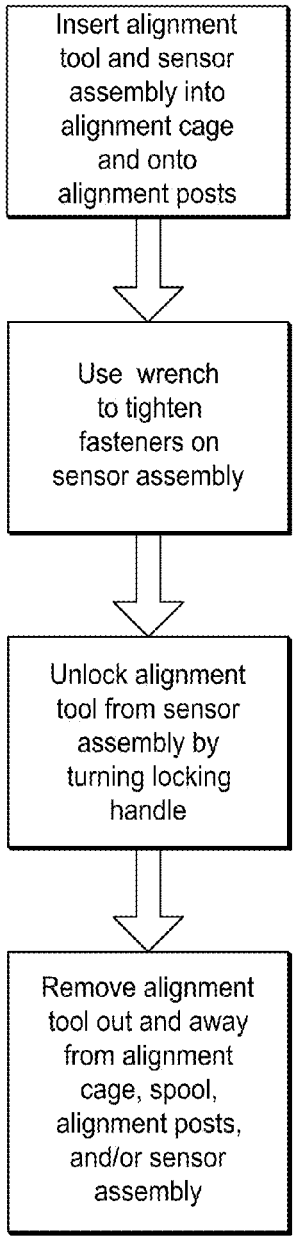
FIG. 12 illustrates an embodiment of a method of installing a sensor.

As shown in FIG. 12, in some embodiments, a method of installing the sensor assembly 10 on the tubular member 202 includes coupling the sensor assembly 10 with the alignment tool 110. The method of installing the sensor assembly 10 can include any or all of the portions of the method of removing the sensor assembly 10, as described above, though the portions may be in a different order or sequence. In certain instances, the sensor assembly 10 and the alignment tool 110 are positioned in the vicinity of the alignment cage 210 and the alignment posts 44, e.g., underwater.

In some embodiments, the method also includes engaging, inserting, or mating the alignment tool 110 with the alignment cage 210. For example, the alignment tool 110 can be held in the alignment cage 210 with positioning features on one or both of the alignment tool 110 and alignment cage 210, e.g., first and second positioning features 118, 222. In some such instances, the guide channel 116 of the alignment tool 110 can receive the alignment rib 220 of the alignment cage 210, thereby facilitating alignment of the alignment tool 110 and the alignment cage 210. In some embodiments, the method further includes mating a detent on the alignment tool 110 with a recess on the alignment rib 220. In certain implementations, such alignment and mating of the alignment tool 110 and the alignment cage 210 results in the sensor assembly 10 being aligned with the alignment posts 44. Indeed, certain arrangements include receiving the alignment posts 44 into the sensor assembly 10.

Certain embodiments of the method of installing the sensor assembly 10 on the tubular member 202 include locking, holding, latching, or otherwise securing the alignment tool 110 to the alignment cage 210. For example, some embodiments include tightening (e.g., by 1, 2, 3, 4, 5, 6, 7, 8, 9, 10, 11, 12, 13, 14, 15 turns, values in between, and otherwise) the fastener 26 of the sensor assembly 10. In some embodiments, tightening the fastener 26 is accomplished with a wrench 140 and/or with an electric or hydraulic motor. In some embodiments, the tightening of the fastener 26 occurs by turning twice in the counter-clockwise direction and about ten times in the clockwise direction. Various other combinations and number of turns can be used to tighten the fasteners 26. As discussed above, in some embodiments, the method or at least one portion of the method can be accomplished using an ROV. Some arrangements include connecting the sensor assembly 10 to the alignment post 44.

In some embodiments, the method includes disengaging, unlocking, decoupling, or otherwise releasing the alignment tool 110 from the sensor assembly 10. For example, in certain implementations the sensor assembly 10 is released from the alignment tool 110 by turning or rotating the locking handle or lever 124 (e.g., by 1/16, 1/8, 1/4, 3/8, 1/2, 5/8, 3/4, 7/8, 1, 1 1/4, 1 1/2, 1 3/4, 2, 3, 4, 5, 6, 7, 8, 9, 10 turns, values in between, and otherwise).

In some embodiments, the method also includes disengaging, unlocking, decoupling, or otherwise releasing the alignment tool 110 from the alignment cage 210. Certain embodiments include separating the alignment tool 110 from the sensor assembly 10. Some implementations also include separating the alignment tool 110 from alignment cage 210 and the alignment posts 44. For example, in certain cases, the alignment tool 110 is brought to the sea surface and the sensor assembly 10 remains coupled with the tubular member 202 underwater.

In certain implementations it can be desirable to calibrate the sensor 19. In some embodiments, a method of calibrating a sensor includes providing a sensor so as to measure a condition (e.g., strain) on a tubular member in an unloaded or unstrained condition (e.g., at sea level, prior to operation), measuring a first output from the sensor in the unloaded condition, measuring a second output from the sensor when the sensor and/or tubular member is in a loaded or strained condition (e.g., subsea, during operation), and comparing the first and second outputs to determine a measured value. In some embodiments, the comparison is accomplished according to the following formula:

$$\text{Measured Value}=\text{Second Output}-\text{First Output}$$

For example, in some embodiments, a strain sensor is installed on a tubular member and the output of the sensor is measured in an un-strained condition as 2 microstrain; the sensor and the tubular member are then lowered to the sea floor, and loaded, and the second output of the sensor is 350 microstrain; the microstrains are compared to determine a measured value of 348 microstrain (e.g., 350 microstrain−2 microstrain=348 micro strain).

In scenarios in which a sensor fails or needs replacement, it is generally desirable to replace the sensor while the tubular member is at the loaded or strained condition (e.g., subsea, during operation). However, as there may have never been an opportunity to measure the first output in the unstrained condition, and also because sensors are generally not perfectly repeatable, the replacement sensor may not exhibit the same measured value as the replaced sensor, thus the measured value of the replacement sensor may deviate from the measured values of other sensors (e.g., sensors that have not been replaced). Further, as it may not be not practicable to raise the tubular member to the surface, determining a first output value for the replacement sensor using the procedure discussed above may be undesirable. Accordingly, the subsea strain sensor assembly 5 and methods of use thereof can be configured to determine a calibration value of a replacement sensor without the need to raise the tubular member to the surface.

Figure 14:
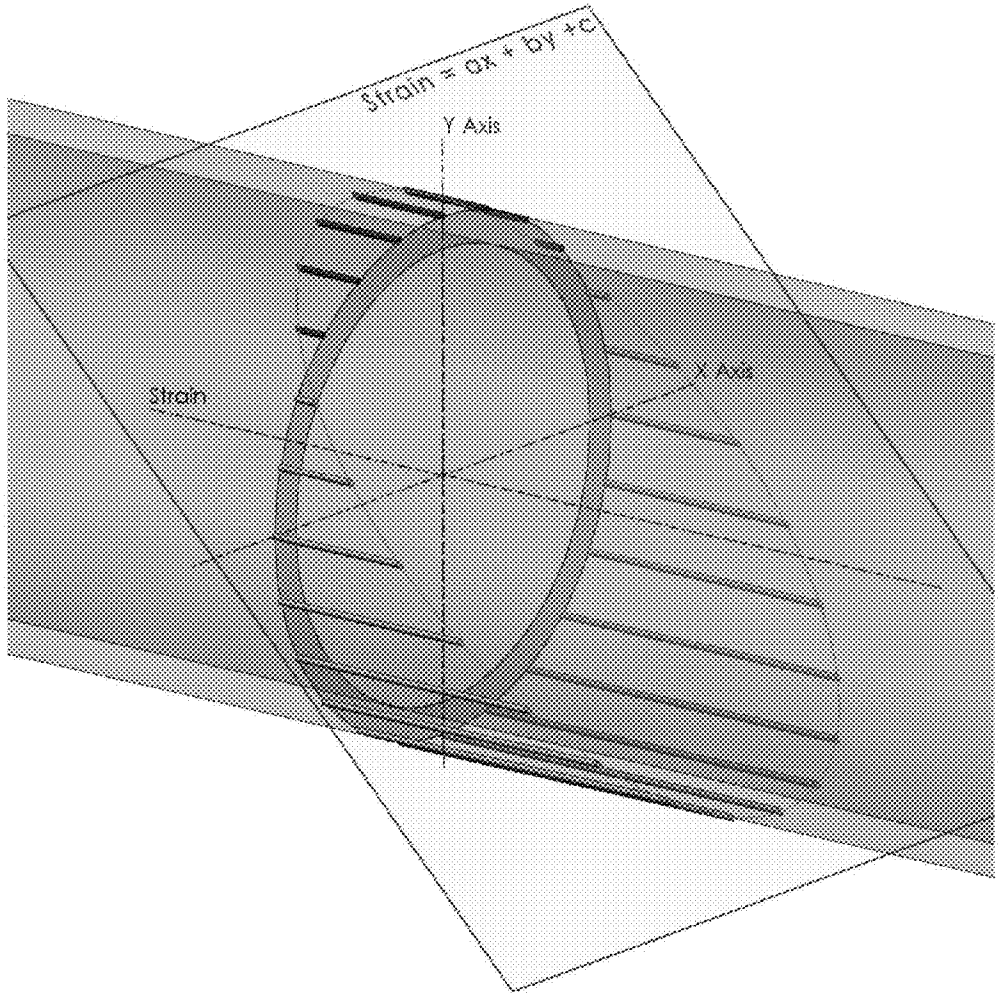
FIG. 14 illustrates a graphical representation of an embodiment of a strain plane in a portion of a tubular member.

For example, in some embodiments, at least three sensors are non-collinearly disposed on the tubular member and a calibration value determined for each of the at least three sensors. The calibration value for each of the at least three sensors can be considered collectively to determine a strain distribution plane (for example, by the method of least-squares), which can describe the net effect of both tensile strain and bending strain. In some embodiments, the strain plane is defined according to the following formula:

$$z=Ax+By+C$$

Where A is the slope of the strain plane in the x-axis (orthogonal to the longitudinal axis L), B is the slope of the strain plane in the y-axis (orthogonal to the x-axis and to the longitudinal axis L), C is an offset of the strain plane, and x, y, and z are coordinates on the strain plane. In particular, z is generally the strain at a point on the strain plane. FIG. 14 provides a graphical representation of an embodiment of a strain plane in a portion of a tubular member.

Given that a replacement sensor is generally installed at about the same location as a replaced sensor, which has a known position on the circumference of the tubular member (and thus has known x and y coordinates), the x and y coordinates of the replacement sensor are also generally known. Accordingly, the measured strain (z on the strain plane corresponding to the known x and y coordinates) can be compared to the second output of the replacement sensor in order to determine a theoretical first output value for the replacement sensor. Thus, in some embodiments, the comparison is done according to the following formula:

$$\text{First Output Value}=\text{Second Output}-\text{Measured Value}$$

The first output value for the replacement sensor can be subtracted from the second output of the replacement sensor thereby fitting the measured output of the replacement sensor to the strain plane.

Although the foregoing has been described in terms of certain specific embodiments, other embodiments will be apparent to those of ordinary skill in the art from the disclosure herein. Moreover, the described embodiments have been presented by way of example only, and are not intended to limit the scope of the disclosure. For instance, embodiments of the subsea strain sensor assembly have been described for use with a tubular member; however many other applications are possible, such as but not limited to use with solid members, I-beam members, flat members, flanged members, plate members, dome members, spherical members, or the like. Indeed, the novel methods and systems described herein can be embodied in a variety of other forms without departing from the spirit thereof. For example, components can be constructed from materials other than those disclosed herein.

Similarly, components can be differently shaped and/or oriented than illustrated or described herein. Further, various ways of assembly and/or fastening are contemplated, including screws, nuts, bolts, adhesives, press-fit, slip-fit, clamps and the like. For example, in some cases, the sensor assembly fastens to the alignment posts by one or more clasps rather than by the threaded fastener described above. In yet a further combination, the sensor assembly clamps directly to the tubular member. In still a further arrangement, one or more components can be configured to have and/or be provided with desired buoyancy, e.g., neutral buoyancy, such as by coupling to a float. Other combinations, omissions, substitutions and modifications will be apparent to the skilled artisan in view of the disclosure herein. Thus, the present disclosure is not limited by the embodiments described above.

What is claimed is:

1. A monitoring system for an underwater tubular member having a first alignment post and a second alignment post, each of the alignment posts having a plurality of locating features and a tubular section, the monitoring system comprising:

a sensor assembly configured to measure strain on the tubular member, the sensor assembly including a first end comprising a first mount configured to couple and decouple with the first alignment post and a second end comprising a second mount configured to couple and decouple with the second alignment post;

wherein each mount comprises an aperture and a plurality of alignment features, each of the alignment features configured to engage a corresponding one of the locating features of a corresponding one of the first and second alignment posts;

an alignment tool configured to be manipulated by a remotely operated vehicle and to couple with the sensor assembly, the alignment tool having, a first opening, and a second opening, the first opening configured to receive the first end of the sensor assembly and the second opening configured to receive the second end of the sensor assembly;

wherein, when the first end of the sensor assembly is received in the first opening of the alignment tool and each of the alignment features of the first mount are engaged with a corresponding one of the locating features of the first alignment post, the aperture of the first mount is substantially aligned with the tubular section of the first alignment post, thereby facilitating engagement of a first fastener between the aperture of the first mount and the tubular section of the first alignment post, the first fastener configured to secure the first end of the sensor assembly to the underwater tubular member; and wherein, when the second end of the sensor assembly is received in the second opening of the alignment tool and each of the alignment features of the second mount are engaged with a corresponding one of the locating features of the second alignment post, the aperture of the second mount is substantially aligned with the tubular section of the second alignment post, thereby facilitating engagement of a second fastener between the aperture of the second mount and the tubular section of the second alignment post, the second fastener configured to secure the second end of the sensor assembly to the underwater tubular member.

2. The monitoring system of claim 1, wherein the locating features each comprise a cylindrical recess, conical recess, and elongated valley, and the alignment features each comprise substantially first, second, and third hemispherical features, the first hemispherical feature configured to engage the cylindrical recess, the second hemispherical feature configured to engage the conical recess, and the third hemispherical feature configured to engage the elongated valley.

3. The monitoring system of claim 1, further comprising the first and second alignment posts.

4. The monitoring system of claim 1, wherein:

the sensor assembly further includes a notch;

at least the first opening of the alignment tool includes a latch element, the latch element being movable between an extended position and a retracted position; and the latch is configured to move from the retracted position to the extended position, and be received in the notch, when the alignment cage is received in the alignment tool.

5. The monitoring system of claim 4, wherein the alignment tool further comprises a lever configured to move the latch element between the extended and retracted positions.

6. The monitoring system of claim 1, wherein the first mount includes a first mounting block configured to engage the first alignment post and the second mount includes a second mounting block configured to engage the second alignment post.

7. The monitoring system of claim 6, wherein:

the first and second alignment posts each further comprises a base, conduit, and spool;

each of the mounting blocks is configured to receive a respective one of the spools.

8. The monitoring system of claim 1, further comprising a wrench configured to engage and turn the first and second fasteners, the wrench being configured to be manipulated underwater by the remotely operated vehicle.

9. The monitoring system of claim 1, wherein the first and second fasteners are not driven by a motor on the alignment tool.

10. The monitoring system of claim 1, wherein the alignment tool includes an upper section and a lower section with a middle section therebetween, the middle section being narrower than the upper and lower sections.

11. The monitoring system of claim 1, wherein the alignment tool further comprises a handle for positioning the alignment tool.

12. A monitoring system for a tubular member having a first mounting point and a second mounting point disposed at fixed locations on the tubular member, the system comprising:

a sensor assembly having a first end configured to couple and decouple to the first mounting point and a second end configured to couple and decouple to the second mounting point;

the sensor assembly having a first mount block at a first end and a second mount block at a second end, each of the mount blocks having a first positioning face including cylindrically-shaped first locating features configured to receive substantially spherical or hemispherical positioning elements;

a first alignment post joinable with the tubular member at the first mounting point and a second alignment post joinable with the tubular member at the second mounting point;

each of the alignment posts including a base with a tubular section extending therefrom, the base including a second positioning face having second locating features comprising a cylindrical recess, a conical recess, and an elongated valley;

wherein the first and second mount blocks are configured to each couple with one of the first and second alignment posts; and wherein, when the respective alignment posts and mount blocks are coupled, the respective first and second locating features are aligned so as to receive the first positioning element in the respective second locating feature, thereby locating the sensor assembly at the predetermined points on the tubular member, even when the tubular member is positioned at or near the sea floor.

13. The monitoring system of claim 12, wherein the alignment posts are installed on the tubular member prior to the tubular member being submerged.

14. The monitoring system of claim 12, wherein the sensor assembly further comprises an elongate spacer bar connected to an armature interfaced with a sensor body having a sensor configured to measure displacement of the armature relative to the sensor body.

15. The monitoring system of claim 12, wherein, when the respective alignment posts and mount blocks are coupled, a conduit of each respective alignment post is coaxial with, or about coaxial with, an axial passage of the respective mount block.

16. The monitoring system of claim 12, further comprising an alignment tool that is connectable to the sensor assembly and configured to mate with the first and second ends of the sensor assembly to facilitate the coupling and decoupling of the first end with the alignment post at the first mounting point and the second end with the alignment post at the second mounting point.

17. The monitoring system of claim 16, wherein the alignment tool further comprises upper and lower sections including openings configured to receive a vertically extending member of each respective mounting block of the sensor assembly, one or both of the openings including one or more latch elements.

18. The monitoring system of claim 17, wherein the alignment tool further comprises a lever coupled with a cam that contacts one or more tappets connected to a translation member, the translation member connecting to one or more of the latch elements.

19. The monitoring system of claim 18, wherein, when the sensor assembly and alignment tool are engaged, a locked position of the alignment tool and sensor assembly can be achieved by rotating the lever.

20. The monitoring system of claim 19, wherein rotation of the lever rotates the cam which can move the one or more latch elements into an extended position, wherein in the extended position the latch elements engage a notch in the vertically extending member of the respective mount block.

* * * * *